US011686085B2

(12) United States Patent
Paso

(10) Patent No.: US 11,686,085 B2
(45) Date of Patent: Jun. 27, 2023

(54) METHOD FOR ASSEMBLING AN ARRANGEMENT AND A CORRESPONDING ASSEMBLABLE ARRANGEMENT

(71) Applicant: Lovi Oy, Jääli (FI)

(72) Inventor: Anne Paso, Jääli (FI)

(73) Assignee: LOVI OY, Jääli (FI)

( * ) Notice: Subject to any disclaimer, the term of this patent is extended or adjusted under 35 U.S.C. 154(b) by 0 days.

(21) Appl. No.: 17/412,870

(22) Filed: Aug. 26, 2021

(65) Prior Publication Data

US 2021/0381222 A1 Dec. 9, 2021

Related U.S. Application Data

(63) Continuation of application No. 15/738,724, filed as application No. PCT/FI2015/050468 on Jun. 25, 2015, now abandoned.

(51) Int. Cl.
*E04B 1/343* (2006.01)
*A63H 33/08* (2006.01)

(52) U.S. Cl.
CPC ..... *E04B 1/34321* (2013.01); *E04B 1/34384* (2013.01); *E04B 2001/34389* (2013.01)

(58) Field of Classification Search
CPC ..... E04B 1/34384; E04B 1/34321; E04B 2001/34389; A63H 33/084
USPC ..... 52/79.5
See application file for complete search history.

(56) References Cited

U.S. PATENT DOCUMENTS 4,551,960 A * 11/1985 Fleishman ..... E04B 1/1903 403/172
5,465,961 A * 11/1995 Burtch ..... A63F 9/02 273/317.1
5,525,060 A * 6/1996 Loebner ..... G09B 19/08 434/157
5,762,336 A * 6/1998 Miller, Jr. ..... A63F 9/12 273/156

(Continued)

FOREIGN PATENT DOCUMENTS

EP 1530990 B 3/2007
JP H09187580 A 7/1997

(Continued)

OTHER PUBLICATIONS

Korean Office Action, Application No. 10-2018-7002330, dated Apr. 6, 2022.

(Continued)

*Primary Examiner* — Brian E Glessner
*Assistant Examiner* — James J Buckle, Jr.
(74) *Attorney, Agent, or Firm* — MacMillan, Sobanski & Todd, LLC

(57) ABSTRACT

The invention relates to a method for assembling an arrangement. The invention also relates to a corresponding assemblable arrangement. For the arrangement according to the invention, there are at least two groups of individual elements and each group comprises at least two individual elements. For each group of at least two elements within one group of elements, the at least two elements can be fitted together. Further, the at least two elements of one group can be fitted together with at least two elements of another group. Each group of elements forms a layer of the arrangement. The arrangement, when assembled, forms a three dimensional object.

7 Claims, 11 Drawing Sheets

(56) References Cited

U.S. PATENT DOCUMENTS 5,827,104 A * 10/1998 Zheng ..... A63H 33/084 446/114
5,833,512 A * 11/1998 Nicola ..... A63H 33/08 446/116
D527,302 S * 8/2006 Vladamirov ..... D11/131
7,273,404 B2 * 9/2007 Kowalski ..... A63H 33/046 446/85
7,469,898 B2 * 12/2008 Forakis ..... A63F 9/1252 273/156
7,708,317 B2 * 5/2010 Leblanc ..... F16L 21/002 285/31
8,506,206 B2 * 8/2013 Desmeules ..... E02D 27/12 405/251
10,293,246 B2 * 5/2019 Douglass, II ..... A63F 9/1208
2004/0118056 A1 * 6/2004 Peters ..... A63H 33/084 52/79.14
2005/0155308 A1 7/2005 Kowalski et al.
2016/0032581 A1 * 2/2016 Sklar ..... E04C 3/122 52/220.8
2016/0317939 A1 * 11/2016 Fernandez ..... A63H 33/084
2017/0036135 A1 * 2/2017 Brown ..... G09B 1/36
2019/0344188 A1 * 11/2019 Gutierrez ..... A63H 33/084

FOREIGN PATENT DOCUMENTS

JP 2010240310 A 10/2010
JP 2014200280 A 10/2014
JP 3196890 U 4/2015

OTHER PUBLICATIONS

Li et al., "Evidence of common knowledge 1: Material Composition", Liaoning Art Press, 2014, pp. 42-44.
Chinese Office Action, Notification of Reexamination, Application No. 201580082670.5, dated Dec. 10, 2021.

* cited by examiner

METHOD FOR ASSEMBLING AN ARRANGEMENT AND A CORRESPONDING ASSEMBLABLE ARRANGEMENT

PRIORITY

This application is a continuation of Ser. No. 15/738,724 filed on Dec. 21, 2017, which is a U.S national application of the international application number PCT/FI2015/050468 filed on Jun. 25, 2015, the contents of which are incorporated herein by reference in their entireties

TECHNICAL FIELD OF THE INVENTION

The invention relates to a method for assembling an arrangement. The invention also relates to a corresponding assemblable arrangement.

BACKGROUND OF THE INVENTION

Method for forming a three-dimensional object and a corresponding object is disclosed in EP1530990. The method and object according to EP1530990 is suitable for relatively small objects such as decorations, for example. Applying the method and object according to EP1530990 for larger objects such as interior design elements for high spaces, echo cancellation elements, decorative pillars, cotes, artificial trees and other three-dimensional objects that require, for example, significant height carries certain practical problems.

Firstly, larger three-dimensional objects if created and manufactured as disclosed in EP1530990 are highly impractical to pack, store and transport as they require large packages in terms of height or width or both. Costs of packaging, storing and transportation of such larger three-dimensional objects are uneconomically high and need to be reduced.

Also, larger three-dimensional objects if manufactured as disclosed in EP1530990 are difficult to assemble as each single element is relatively high or wide. A single person cannot assemble such larger three-dimensional objects independently. Depending on the space to which the object is to be placed it is also possible that the object needs to be assembled either outside or transported readily assembled as very high or wide objects require a lot of space for assembling as well and there are also potential safety issues in assembling them. Problems of assembling must be solved for such larger three-dimensional objects.

Further, manufacturing larger three-dimensional objects as disclosed in EP1530990 causes significant material waste. The more complex a single element of the three-dimensional object is, the more waste material is produced if the single element is manufactured in one piece only. Also, if during manufacturing even one of the elements of object turns out to be of low quality, the whole faulty element is wasted. In case of larger elements the amount of wasted materials in both cases becomes uneconomically high and causes unnecessary manufacturing costs. Both material waste and manufacturing costs thereto need to be reduced.

Therefore, a method for assembling an arrangement and a corresponding assemblable arrangement are needed to solve the certain problems and limitations presented above.

SUMMARY OF SOME EXAMPLES OF THE INVENTION

The object of the present invention is to provide a method for assembling an arrangement that forms a three-dimensional object. The object of the present invention is also to provide a corresponding assemblable arrangement that forms a three-dimensional object.

Also, the object of the present invention is to enable manufacturing of a relatively large three dimensional object as an assemblable arrangement that can be cost effectively packaged, stored and transported by using smaller elements to create also a large three-dimensional object.

Further, the object of the present invention is to enable design and manufacturing of a relatively large three dimensional object as an arrangement that can be assembled on the space where the object is to be placed by using smaller elements to create also a large three-dimensional object. The object of the present invention is to make the assembly of the object safe.

Moreover, the object of the present invention is to reduce material waste caused while manufacturing a large three-dimensional objects according to methods known in prior art by allowing more effective use of production material with using smaller elements to create also a large three-dimensional object.

Finally, the object of the present invention is to improve production effectiveness by using smaller elements to create also a large three-dimensional object as an assemblable arrangement that will allow simultaneous production of several elements for an object to be created.

The objects of the present invention are fulfilled by providing a method for assembling an arrangement comprising creating a first group of at least two first elements where an individual first element comprises

- at least one first edge surface and at least one second edge surface that are on a distance from each other,
- at least one slot,
- a neck with less height than the distance of the at least one first edge surface and the at least one second edge surface, and
- the at least two first elements can be fitted at least partially together crosswise so that the at least one slot of at least one first element is at least partially dimensioned against the neck of at least one other first element and fitting at least two first elements at least partially together correspondingly wherein the arrangement further comprises creating a second group of at least two second elements where an individual second element comprises

- at least one first edge surface and at least one second edge surface that are on a distance from each other,
- at least one slot,
- a neck with less height than the distance of the at least one first edge surface and the at least one second edge surface, and
- the at least two second elements can be fitted at least partially together crosswise so that the at least one slot of at least one second element is at least partially dimensioned against the neck of at least one other second element, fitting the at least two second elements are at least partially together correspondingly, and fitting the at least one second edge surface of at least one second element at least partially against the at least one first edge surface of the at least one first element so that each group of elements forms a layer of the arrangement.

Also, the objects of the present invention are fulfilled by providing an assemblable arrangement comprising a first group of at least two first elements where an individual first element comprises

- at least one first edge surface and at least one second edge surface that are on a distance from each other, at least one slot, and a neck with less height than the distance of the at least one first edge surface and the at least one second edge surface, and the at least two first elements can be fitted at least partially together crosswise so that the at least one slot of at least one first element is at least partially dimensioned against the neck of at least one other first element wherein the arrangement further comprises a second group of at least two second elements where an individual second element comprises at least one first edge surface and at least one second edge surface that are on a distance from each other, at least one slot, and a neck with less height than the distance of the at least one first edge surface and the at least one second edge surface, and the at least two second elements can be fitted at least partially together crosswise so that the at least one slot of at least one second element is at least partially dimensioned against the neck of at least one other second element, and the at least one second edge surface of at least one second element can be fitted at least partially against at least one first edge surface of at least one first element so that each group of elements forms a layer of the arrangement.

The basic idea of the present invention is as follows: There are at least two groups of individual elements and each group comprises at least two individual elements. Each individual element comprises at least one first edge surface and at least one second edge surface that are on a distance from each other, at least one slot that is relatively narrow and extends towards inner of the element and a neck with less height than the distance of the at least one first edge surface and the at least one second edge surface.

For each group of at least two elements within one group of elements, the at least two elements can be fitted together. The at least two elements within one group of elements can be fitted at least partially together so that the at least one slot of at least one element is dimensioned at least partially crosswise against the neck of at least one other element. To assemble the arrangement the at least two elements within one group are at least partially fitted together correspondingly.

Further, the at least two elements of one group can be fitted together with at least two elements of another group. The at least two elements of one group can be fitted together with at least two elements of another group so that the at least one second edge surface of at least one element from one group is fitted at least partially against at least one first edge surface of at least one element from another group. Each group of elements forms a layer of the arrangement.

Advantageously, the arrangement according to the present invention may be applied for various purposes such as to be used as a basis for a temporary interior pillar, a decorative pillar, a cote or a part of a cote, an artificial tree, a temporary interior construction or other such temporary constructions. Also, advantageously, the arrangement according to the present invention may be made of at least one of the following: plywood, plywood with echo cancelling cover material, artificial wood material, material suitable for echo cancelling, cardboard and plastic. Moreover, advantageously, the arrangement according to the present invention may be used as an echo cancelling element. More advantageously, the arrangement according to the present invention may be applied for forming three—dimensional objects of varying sizes and measures. Very advantageously, the arrangement according to the invention, when assembled, forms a non-collapsible three-dimensional object.

In one advantageous embodiment of the invention further layers can be added to the arrangement by adding at least one more group of at least two elements. The at least two elements of a new group can be fitted together with at least two elements of a previously assembled group of elements so that the at least one second edge surface of at least one element from the new group is fitted at least partially against at least one first edge surface of at least one element from the previously assembled group. Each group of elements forms a new layer of the arrangement.

In another advantageous embodiment of the invention the first edge surfaces of the at least two elements of at least one group of elements are at least partially positioned on the same level compared to each other when fitted together.

In a third advantageous embodiment of the invention the first edge surfaces of the at least two elements of at least one group of elements are positioned on different levels compared to each other when fitted together. The first edge surfaces of the at least two elements of at least one group of elements rise spirally like steps.

In a fourth advantageous embodiment of the invention at least one individual element of at least one group of at least two elements is adapted to be a connection element that connects at least two arrangements with each other. This allows creating combinations of at least two arrangements according to the present invention.

Further scope of applicability of the present invention will become apparent from the detailed description given hereafter. However, it should be understood that the detailed description and specific examples, while indicating preferred embodiments of the invention, are given by way of illustration only, since various changes and modifications to these exemplary embodiments of the invention will become apparent to those skilled in the art from this detailed description.

BRIEF DESCRIPTION OF THE DRAWINGS

The present invention will become more fully understood from the detailed description given herein below and accompanying drawings which are given by way of illustration only, and thus are not limitative of the present invention and wherein IG. 1*a* shows an exemplary individual element according to the invention.

DETAILED DESCRIPTION

In the following description, considered embodiments are merely exemplary, and one skilled in the art may find other ways to implement the invention. Although the specification may refer to "an", "one; or "some" embodiment(s) in several locations, this does not necessarily mean that each such reference is made to the same embodiment(s), or that the feature only applies to a single embodiment. Single feature of different embodiments may also be combined to provide other embodiments.

Figure 1A:
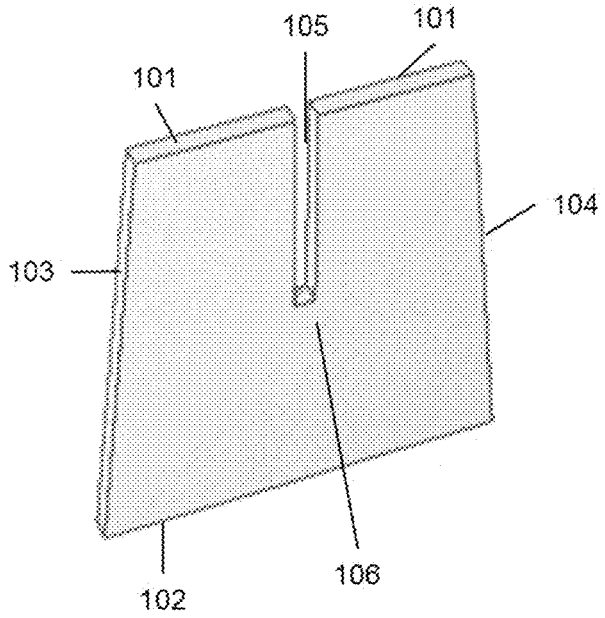
FIG. 1*b* shows another exemplary individual element according to the invention.
FIG. 1*c* shows a third exemplary individual element according to the invention.
FIG. 1*d* shows a fourth exemplary individual element according to the invention.

FIG. 1*a* shows an exemplary individual element according to the invention. The element comprises at least one first edge surface 101, at least one second edge surface 102, at least one slot 105 and a neck 106. The at least one first edge surface 101 and the at least one second edge surface 102 are on distance from each other. The at least one first edge surface 101 and the at least one second edge surface 102 are on distance from each other and the distance is defined by the length of at least one first side surface 103 and at least one second side surface 104. The at least one first side surface 103 and the at least one second side surface 104 are on distance from each other. The at least one first side surface 103 and the at least one second side surface 104 are on distance from each other and the distance is defined by at least the length of the at least one first edge surface 101 and the at least one second edge surface 102.

The at least one slot 105 extends from the at least one first edge surface 101 towards the inner part of the element. Advantageously, the at least one slot 105 extends from the at least one first edge surface 101 towards the inner part of the element to a neck 106 of the element. The length of the at least one slot 105 is less than the length of the at least one first side surface 103. The length of the at least one slot 105 is also less than the length of the at least one second side surface 104. The length of the at least one slot 105 is less than the length of the at least one first side surface 103 and the at least one second side surface 104.

The neck 106 divides the element into a first half and a second half. The first half is a part of the element that is on the side of the at least one first side surface 103. The second half is a part of the element that is on the side of the at least one second side surface 104. The height of the neck 106 is less than the distance of the at least one first edge surface 101 and the at least one second edge surface 102. The height of the neck 106 is less than the length of the at least one first side surface 103. The height of the neck 106 is less than the length of the at least one second side surface 104. Advantageously, the height of the neck 106 is less than the length of the at least one first side surface 103 and the at least one second side surface 104. The width of the neck 106 is at most the width of the widest slot 105 of the element. The width of the neck 106 is less than the length of the first edge surface 101. The width of the neck 106 is less than the length of the second edge surface 102. The width of the neck 106 is less than the length of the first edge surface 101 and the second edge surface 102.

Figure 1B:
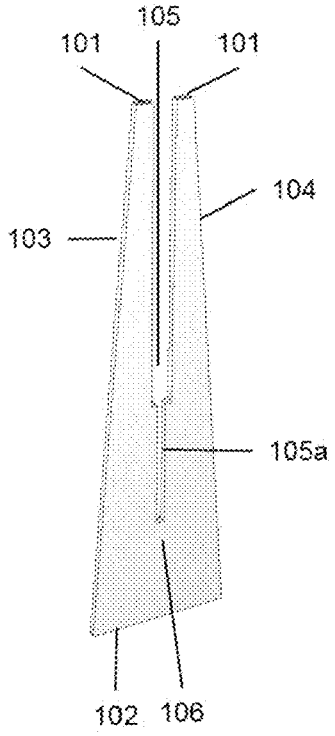

FIG. 1*b* shows another exemplary individual element according to the invention. The element comprises at least one first edge surface 101, at least one second edge surface 102, at least one slot 105, at least one inner slot 105*a* and a neck 106. The at least one first edge surface 101 and the at least one second edge surface 102 are on distance from each other. The at least one first edge surface 101 and the at least one second edge surface 102 are on distance from each other and the distance is defined by the length of at least one first side surface 103 and at least one second side surface 104. The at least one first side surface 103 and the at least one second side surface 104 are on distance from each other. The at least one first side surface 103 and the at least one second side surface 104 are on distance from each other and the distance is defined by at least the length of the at least one first edge surface 101 and the at least one second edge surface 102.

The at least one slot 105 extends from the at least one first edge surface 101 towards the inner part of the element. Advantageously, the at least one slot 105 extends from the at least one first edge surface 101 towards the inner part of the element to a neck 106 of the element. The length of the at least one slot 105 is less than the length of the at least one first side surface 103. The length of the at least one slot 105 is also less than the length of the at least one second side surface 104. The length of the at least one slot 105 is less than the length of the at least one first side surface 103 and the at least one second side surface 104. More advantageously, the at least one slot 105 extending from the first edge surface 101 is continued by at least one inner slot 105*a* that extends from the end of the at least one slot 105 towards more inner part of the element than the at least one 105 on its own. The length of the at least one slot 105 and the at least one inner slot 105*a* together is less than the length of the at least one first side surface 103. The length of the at least one slot 105 and the at least one inner slot 105*a* together is also less than the length of the at least one second side surface 104. The length of the at least one slot 105 and the at least one inner slot 105*a* together is less than the length of the at least one first side surface 103 and the at least one second side surface 104. The width of the at least one inner slot 105*a* is less than the width of the at least one slot 105.

The neck 106 divides the element into a first half and a second half. The first half is a part of the element that is on the side of the at least one first side surface 103. The second half is a part of the element that is on the side of the at least one second side surface 104. The height of the neck 106 is less than the distance on which the at least one first edge surface 101 and the at least one second edge surface 102 are from each other. The height of the neck 106 is less than the length of the at least one first side surface 103. The height of the neck 106 is less than the length of the at least one second side surface 104. Advantageously, the height of the neck 106 is less than the length of the at least one first side surface 103 and the at least one second side surface 104. The length of the at least one slot 105 defines the height of the neck 106 so that the height of the neck is at most the separation of the length of the first side surface 103 and the length of the at least one slot 105. If there is an inner slot 105*a*, the length of the at least one slot 105 and the at least one inner slot 105*a* together defines the height of the neck 106 so that the height of the neck is at most the separation of the length of the first side surface 103 and the length of the at least one slot 105 and the at least one inner slot 105*a* together. The width of the neck 106 is at most the width of the widest slot 105 of the element. The width of the neck 106 is less than the length of the first edge surface 101. The width of the neck 106 is less than the length of the second edge surface 102. The width of the neck 106 is less than the length of the first edge surface 101 and the second edge surface 102.

Figure 1C:
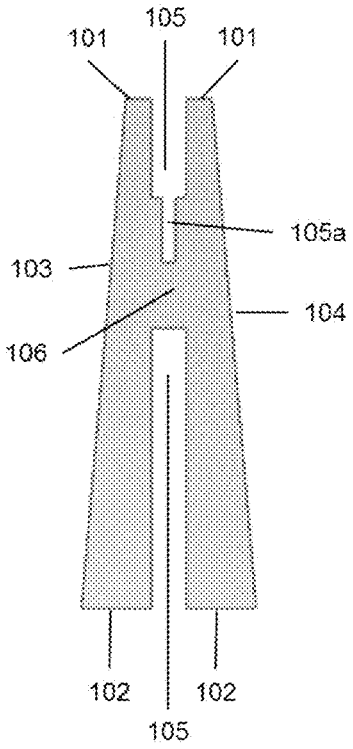

FIG. 1*c* shows a third exemplary individual element according to the invention. The element comprises at least one first edge surface 101 and at least one second edge surface 102. The at least one first edge surface 101 and the at least one second edge surface 102 are on distance from each other. The at least one first edge surface 101 and the at least one second edge surface 102 are on distance from each other and the distance is defined by the length of at least one first side surface 103 and at least one second side surface 104. The at least one first side surface 103 and the at least one second side surface 104 are on distance from each other. The at least one first side surface 103 and the at least one second side surface 104 are on distance from each other and the distance is defined by at least the length of the at least one first edge surface 101 and the at least one second edge surface 102.

The at least one slot 105 extends from the at least one first edge surface 101 towards the inner part of the element. Advantageously, the at least one slot 105 extends from the at least one first edge surface 101 towards the inner part of the element to a neck 106 of the element. The length of the at least one slot 105 is less than the length of the at least one first side surface 103. The length of the at least one slot 105 is also less than the length of the at least one second side surface 104. The length of the at least one slot 105 is less than the length of the at least one first side surface 103 and the at least one second side surface 104. More advantageously, the at least one slot 105 extending from the first edge surface 101 is continued by at least one inner slot 105*a* that extends from the end of the at least one slot 105 towards more inner part of the element than the at least one 105 on its own. The length of the at least one slot 105 and the at least one inner slot 105*a* together is less than the length of the at least one first side surface 103. The length of the at least one slot 105 and the at least one inner slot 105*a* together is also less than the length of the at least one second side surface 104. The length of the at least one slot 105 and the at least one inner slot 105*a* together is less than the length of the at least one first side surface 103 and the at least one second side surface 104. The width of the at least one inner slot 105*a* is less than the width of the at least one slot 105. In this advantageous embodiment, also another at least one slot 105 extends from the at least one second edge surface 102 towards the inner part of the element to the neck 106 of the element. More advantageously, the at least one slot 105 extending from the at least one second edge surface 102 towards the inner part of the element to the neck 106 of the element may also have at least one inner slot 105*a* that extends from the end of the said at least one slot 105 to more inner parts of the element than the said at least one slot 105 on its own.

The neck 106 divides the element into a first half and a second half. The first half is a part of the element that is on the side of the at least one first side surface 103. The second half is a part of the element that is on the side of the at least one second side surface 104. The height of the neck 106 is less than the distance on which the at least one first edge surface 101 and the at least one second edge surface 102 are from each other. The height of the neck 106 is less than the length of the at least one first side surface 103. The height of the neck 106 is less than the length of the at least one second side surface 104. Advantageously, the height of the neck 106 is less than the length of the at least one first side surface 103 and the at least one second side surface 104. The length of the at least one slot 105 defines the height of the neck 106 so that the height of neck is at most the separation of the length of the first side surface 103 and the length of the at least one slot 105. If there is an inner slot 105*a*, the length of the at least one slot 105 and the at least one inner slot 105*a* together defines the height of the neck 106 so that the height of the neck is at most the separation of the length of the first side surface 103 and the length of the at least one slot 105 and the at least one inner slot 105*a* together. The width of the neck 106 is at most the width of the widest slot 105 of the element. The width of the neck 106 is less than the length of the first edge surface 101. The width of the neck 106 is less than the length of the second edge surface 102. The width of the neck 106 is less than the length of the first edge surface 101 and the second edge surface 102.

Figure 1D:
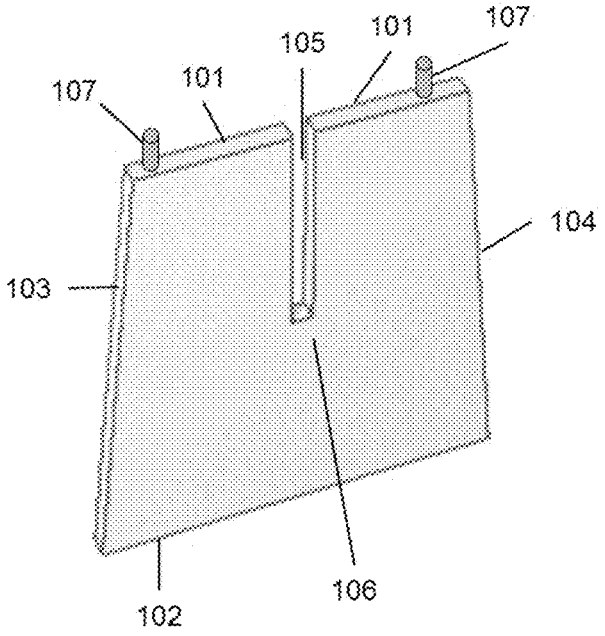

FIG. 1*d* shows a fourth exemplary individual element according to the invention. The element comprises at least one first edge surface 101, at least one second edge surface 102, at least one slot 105, a neck 106 and at least one joint organ 107. The element according to this advantageous embodiment may also comprise at least one inner slot 105*a* according to FIGS. 1*b* and 1*c*. The at least one first edge surface 101 and the at least one second edge surface 102 are on distance from each other. The at least one first edge surface 101 and the at least one second edge surface 102 are on distance from each other and the distance is defined by the length of at least one first side surface 103 and at least one second side surface 104. The at least one first side surface 103 and the at least one second side surface 104 are on distance from each other. The at least one first side surface 103 and the at least one second side surface 104 are on distance from each other and the distance is defined by at least the length of the at least one first edge surface 101 and the at least one second edge surface 102.

The at least one slot 105 extends from the at least one first edge surface 101 towards the inner part of the element. Advantageously, the at least one slot 105 extends from the at least one first edge surface 101 towards the inner part of the element to a neck 106 of the element. Also advantageously, the at least one slot 105 extends from the at least one second edge surface 102 towards the inner part of the element to a neck 106 of the element.

The neck 106 divides the element into a first half and a second half. The first half is a part of the element that is on the side of the at least one first side surface 103. The second half is a part of the element that is on the side of the at least one second side surface 104. The height of the neck 106 is less than the distance on which the at least one first edge surface 101 and the at least one second edge surface 102 are from each other. The height of the neck 106 is less than the length of the at least one first side surface 103. The height of the neck 106 is less than the length of the at least one second side surface 104. Advantageously, the height of the neck 106 is less than the length of the at least one first side surface 103 and the at least one second side surface 104. The length of the at least one slot 105 defines the height of the neck 106 so that the height of neck is at most the separation of the length of the first side surface 103 and the length of the at least one slot 105. If there is an inner slot 105*a*, the length of the at least one slot 105 and the at least one inner slot 105*a* together defines the height of the neck 106 so that the height of the neck is at most the separation of the length of the first side surface 103 and the length of the at least one slot 105 and the at least one inner slot 105*a* together. The width of the neck 106 is at most the width of the widest slot 105 of the element. The width of the neck 106 is less than the length of the first edge surface 101. The width of the neck 106 is less than the length of the second edge surface 102. The width of the neck 106 is less than the length of the first edge surface 101 and the second edge surface 102.

The at least one joint organ 107 may be at least one of the following: at least one tap on the at least one first edge surface 101 that fits to at least one hole on at least one second edge surface 102 of another individual element, at least one tap on at least one second edge surface 102 that fits to at least one hole on at least one first edge surface 101 of another individual element, a slot along the length of at least one first edge surface 101 that fits together with at least one second edge surface 102 of another individual element or a slot along the length of at least one second edge surface 102 that fits together with at least one first edge surface 101 of another individual element. The at least one joint organ 107 allows a more durable joint of at least two individual elements.

Figure 2A:
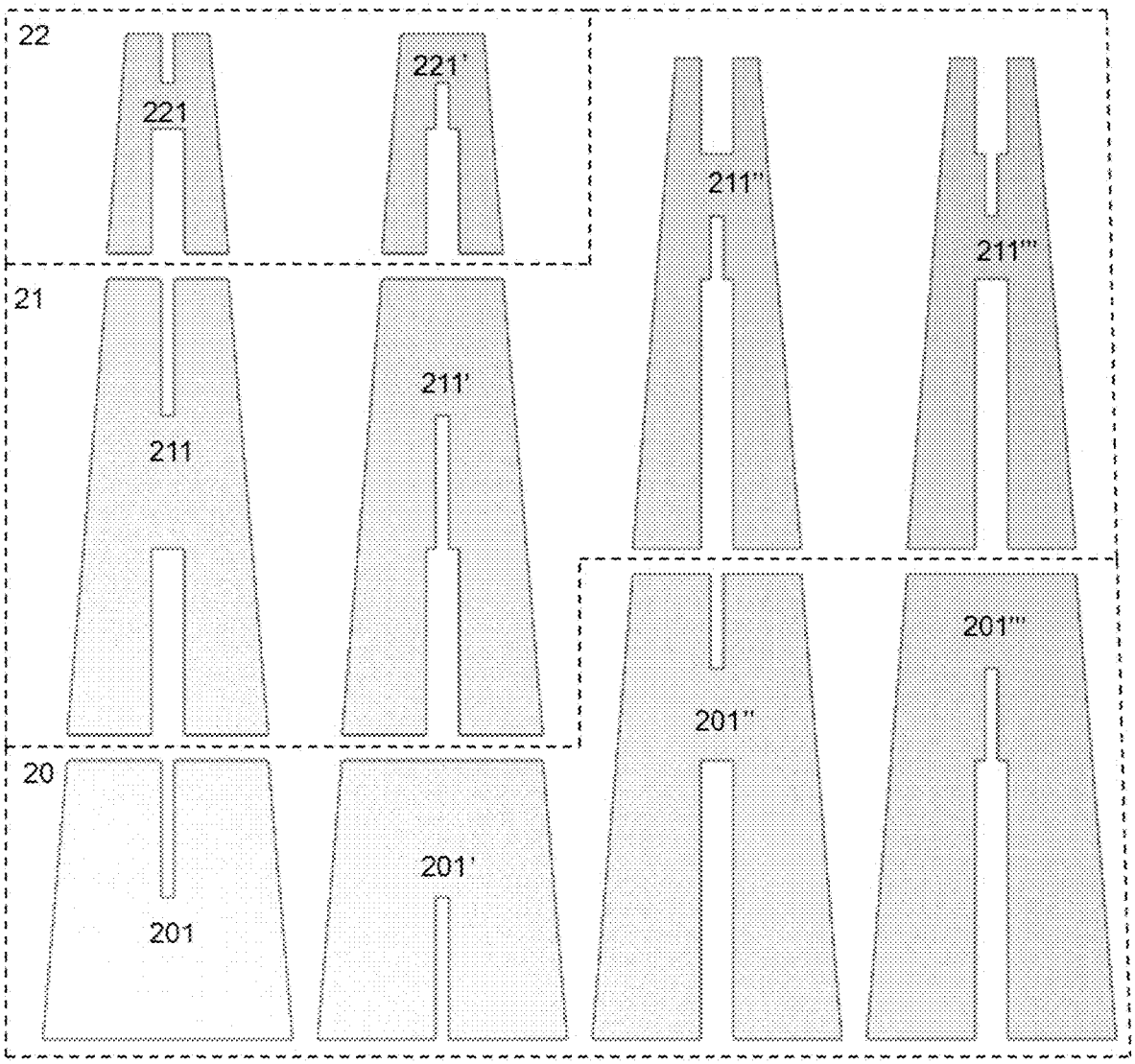
FIG. 2*a* shows an exemplary setting of elements for an arrangement according to the invention.

FIG. 2*a* shows an exemplary setting of elements for an arrangement according to the invention. The arrangement according to the invention comprises at least one first group 20 of at least two first elements. In this advantageous embodiment, the first group 20 comprises four individual first elements 201, 201', 201", and 201'". Further, the arrangement according to the invention comprises at least one second group 21 of at least two second elements. In this advantageous embodiment, the second group 21 comprises four individual second elements 211, 211', 211", and 211'". In this advantageous embodiment, the arrangement according to the invention also comprises at least one third group 22 of at least two third elements. In this embodiment, the third group 22 comprises two individual third elements 221 and 221'. The individual first elements 201, 201', 201", 201'", second elements 211, 211', 211", 211'", and third elements 221, and 221' according to this advantageous embodiment comprise all the characteristics of individual elements 101-107 according to FIGS. 1*a*, 1*b*, 1*c* and 1*d* and references to characteristics according to FIGS. 1*a*, 1*b*, 1*c* and 1*d* are made with corresponding reference numbers.

For the first group 20 of at least two first elements, an individual first element 201, 201', 201", 201'" comprises at least one first edge surface 101 and at least one second edge surface 102 that are on a distance from each other, at least one slot 105, and a neck 106 with less height than the distance of the at least one first edge surface 101 and the at least one second edge surface 102. For the first group 20 of at least two first elements, the at least two first elements 201, 201', 201", 201" can be fitted at least partially together crosswise so that at least one slot 105 of at least one first element is at least partially dimensioned against a neck 106 of at least one other first element.

For the second group 21 of at least two second elements, an individual second element 211, 211', 211", 211'" comprises at least one first edge surface 101 and at least one second edge surface 102 that are on a distance from each other, at least one slot 105, and a neck 106 with less height than the distance of the at least one first edge surface 101 and the at least one second edge surface 102. For the second group 21 of at least two second elements, the at least two second elements 211, 211', 211", 211'" can be fitted at least partially together crosswise so that at least one slot 105 of at least one second element is at least partially dimensioned against a neck 106 of at least one other second element.

For the third group 22 of at least two third elements, an individual third element 221, 221' comprises at least one first edge surface 101 and at least one second edge surface 102 that are on a distance from each other, at least one slot 105, and a neck 106 with less height than the distance of the at least one first edge surface 101 and the at least one second edge surface 102. For the third group 22 of at least two third elements the at least two third elements 221, 221', can be fitted at least partially together crosswise so that at least one slot 105 of at least one third element is at least partially dimensioned against a neck 106 of at least one other third element.

Figure 2B:
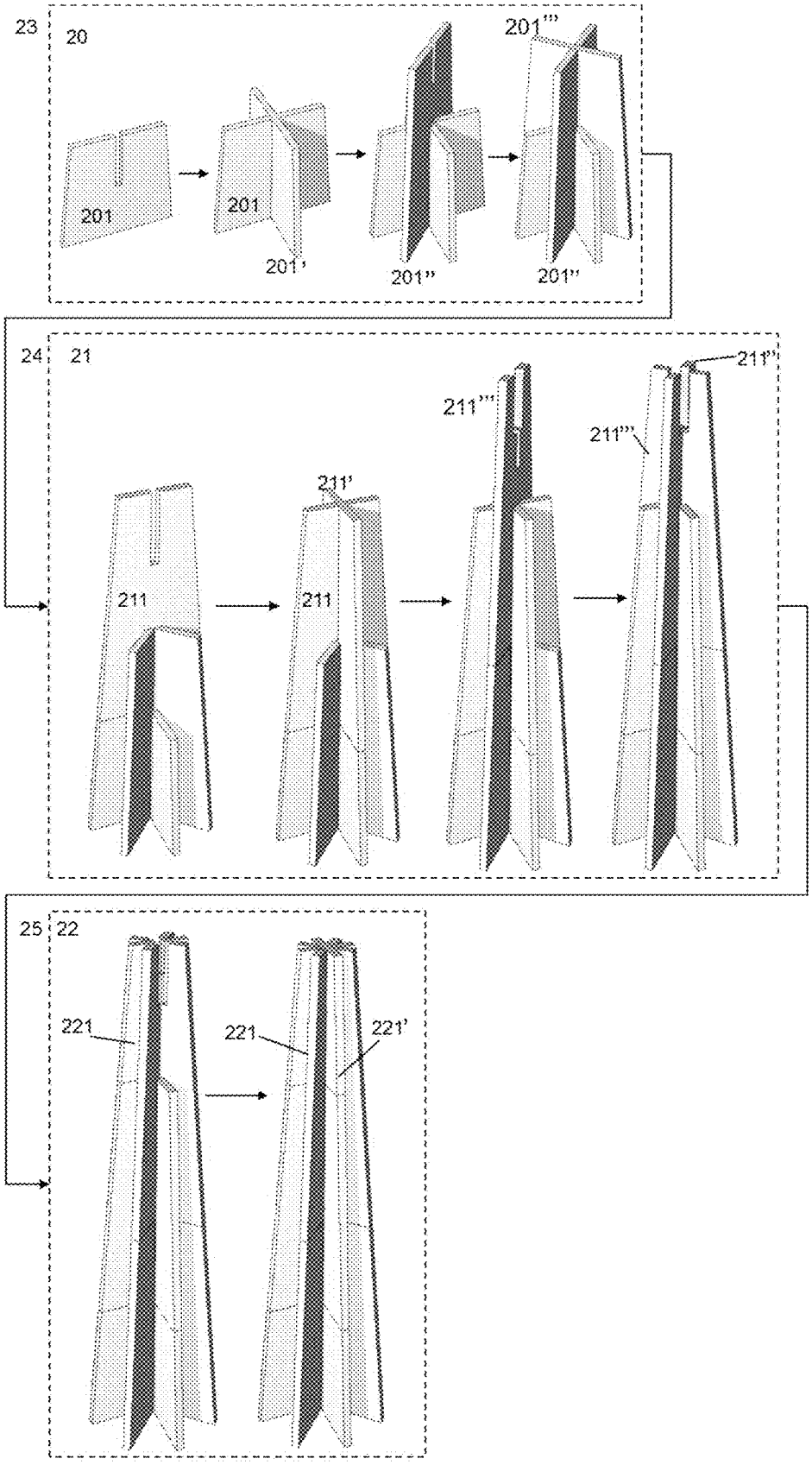
FIG. 2*b* shows an exemplary assembling of elements for an arrangement according to the invention.

FIG. 2*b* shows an exemplary assembling of elements according to FIG. 2*a* for an arrangement according to the invention. The individual first elements 201, 201', 201", 201'", second elements 211, 211', 211", 211'", and third elements 221, 221', according to this advantageous embodiment comprise all the characteristics of individual elements 101-107 according to FIGS. 1*a*, 1*b*, 1*c* and 1*d* and references to characteristics according to FIGS. 1*a*, 1*b*, 1*c* and 1*d* are made with corresponding reference numbers.

In step 23, for the first group 20 of at least two first elements, an individual first element 201, 201', 201", 201'" comprises at least one first edge surface 101 and at least one second edge surface 102 that are on a distance from each other, at least one slot 105, and a neck 106 with less height than the distance of the at least one first edge surface 101 and the at least one second edge surface 102. For the first group 20 of at least two first elements, the at least two first elements 201, 201', 201", 201'" can be fitted at least partially together crosswise so that at least one slot 105 of at least one first element is at least partially dimensioned against a neck 106 of at least one other first element. The at least two first elements of first group 20 are fitted together correspondingly. For the first group 20 of at least two first elements, the at least two first elements are fitted at least partially together crosswise so that at least one slot 105 of at least one first element is at least partially dimensioned against a neck 106 of at least one other first element. The first group 20 of at least two first elements fitted together forms a layer 23 of the arrangement according to the invention.

In step 24, for the second group 21 of at least two second elements, an individual second element 211, 211', 211", 211'" comprises at least one first edge surface 101 and at least one second edge surface 102 that are on a distance from each other, at least one slot 105, and a neck 106 with less height than the distance of the at least one first edge surface 101 and the at least one second edge surface 102. For the second group 21 of at least two second elements, the at least two second elements can be fitted at least partially together crosswise so that at least one slot 105 of at least one second element is at least partially dimensioned against a neck 106 of at least one other second element. The at least two second elements are fitted at least partially together correspondingly. The at least two second elements are fitted at least partially together crosswise so that the at least one slot 105 of at least one second element is at least partially dimensioned against the neck 106 of at least one other second element. Also, the at least one second edge surface 102 of at least one second element can be fitted at least partially against at least one first edge surface 101 of at least one first element 201, 201', 201", 201'". Further, the at least one second edge surface 102 of at least one second element 211, 211', 211", 211'" is fitted at least partially against at least one first edge surface 101 of at least one first element 201, 201', 201", 201'". Advantageously, the at least one second edge surface 102 of at least one second element 211, 211', 211", 211'" is fitted at least partially along the length of the at least one first edge surface 101 of at least one first element 201, 201', 201", 201'". The second group 21 of at least two first elements fitted together and connected with the first group of elements 20 forms a second layer 24 of the arrangement according to the invention.

For the first group 20 of the at least two first elements 201, 201', 201", 201'", and the second group 21 of the at least two second elements 211, 211', 211" 211'", when fitted together according to steps 23 and 24, each group forms a layer 23-24 of the arrangement. The first edge surfaces 101 of the at least two elements 201 of the first group of elements 20 and the first edge surfaces 101 of the at least two elements of the second group of elements 21 are at least partially positioned on the same level compared to each other.

According to step 25, at least one more layer 25 is added to the arrangement. For the third group 22 of at least two third elements, an individual third element 221, 221' comprises at least one first edge surface 101 and at least one second edge surface 102 that are on a distance from each other, at least one slot 105, and a neck 106 with less height than the distance of the at least one first edge surface 101 and the at least one second edge surface 102. For the third group 22 of at least two third elements 221, the at least two third elements 221, 221' can be fitted at least partially together crosswise so that at least one slot 105 of at least one third element is at least partially dimensioned against a neck 106 of at least one other third element 221.

The at least two third elements 221, 221' are fitted at least partially together correspondingly. Further in step 25 the at least two third elements 221 and 221' are fitted at least partially together crosswise so that the at least one slot of 105 at least one third element is at least partially dimensioned against the neck 106 of at least one other third element. Also, the at least one second edge surface 102 of at least one third element can be fitted at least partially against at least one first edge surface 101 of at least one element 211 on the previous layer 24 of the arrangement. Further, the at least one second edge surface 102 of at least one third element 221, 221' is fitted at least partially against at least one first edge surface 101 of at least one second element 211, 211', 211", 211" on the previous layer 24 of the arrangement. Advantageously, the at least one second edge surface 102 of at least one third element 221, 221' is fitted at least partially along the length of the at least one first edge surface 101 of at least one second element 211, 211', 211", 211'" on the previous layer 24 of the arrangement.

The first edge surfaces 101 of the at least two first elements 201, 201', 201", 201'" of the first group of elements 20, the first edge surfaces 101 of the at least two second elements 211, 211', 211", 211'" of the second group of elements 21 and the first edge surfaces 101 of the at least two third elements 221, 221' of the at least one third group of elements are at least partially positioned on the same level compared to each other. The first edge surfaces 101 of the at least two first elements 201, 201', 201", 201'" of the first group of elements 20, the first edge surfaces 101 of the at least two second elements 211, 211', 211', 211'" of the second group of elements 21 and the first edge surfaces 101 of the at least two third elements 221,221' of the at least one third group of elements 22 are at least partially positioned on the same level compared to each other when fitted together. More advantageously, the first edge surfaces 101 of the at least two first elements (201, 201', 201", 201'"), the at least two second elements (211, 211', 211", 211"), the at least two third elements (221,221') of at least one group of elements (20, 21, 22), respectively are at least partially positioned on the same level compared to each other.

Figure 3A:
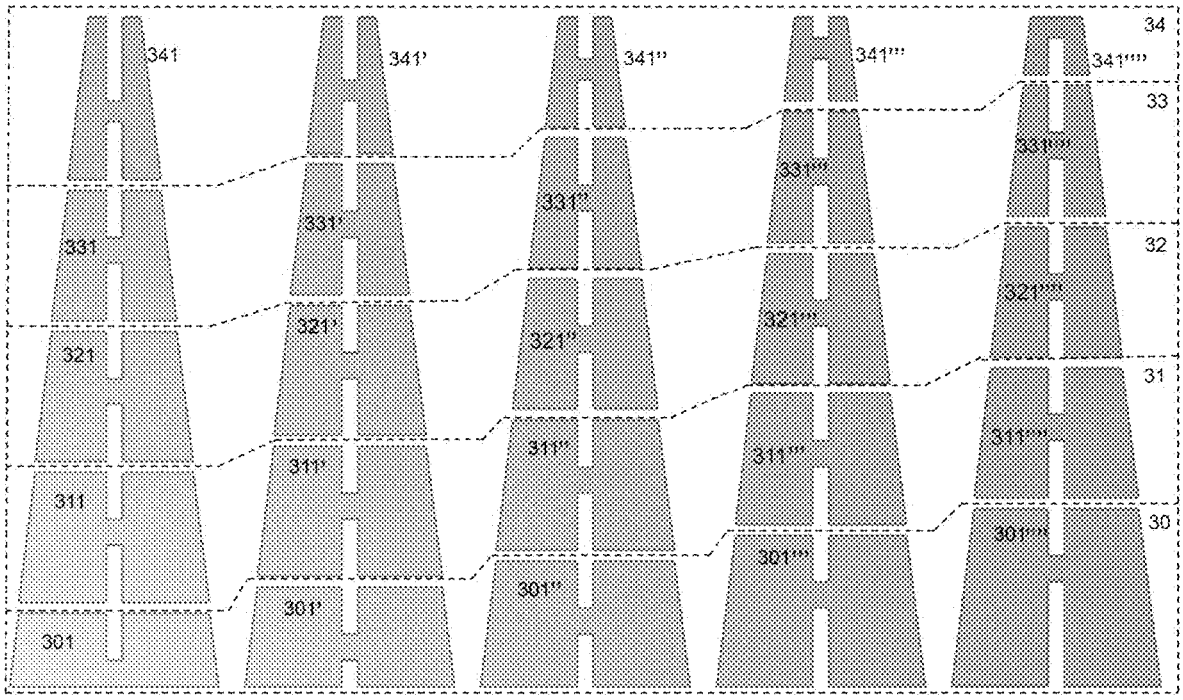
FIG. 3*a* shows another exemplary setting of elements for an arrangement according to the invention.

FIG. 3*a* shows an exemplary setting of elements for an arrangement according to the invention. The arrangement according to the invention comprises at least one first group 30 of at least two first elements. In this advantageous embodiment, the first group 30 comprises five individual first elements 301, 301' 301", 301'", and 301'". Further, the arrangement according to the invention comprises at least one second group 31 of at least two second elements. In this advantageous embodiment, the second group 31 comprises five individual second elements 311, 311', 311", 311'", and 311'". In this advantageous embodiment, the arrangement according to the invention also comprises at least one third group 32-34 of at least two third elements. In this embodiment, each of the at least one third group 32-34 comprises five individual third elements 321, 321', 321", 321'", 321'", 331, 331', 331", 311'", 311'", 341, 341', 341", 341'", and 341'", respectively. The individual first elements 301, 301', 301", 301'", 301'", second elements 311, 311', 311", 311'", 311'", and third elements (321, 321', 321", 321'", 321'", 331, 331', 331", 311'", 311'", 341, 341', 341", 341'", 341'") according to this advantageous embodiment comprise all the characteristics of individual elements 101-107 according to FIGS. 1*a*, 1*b*, 1*c* and 1*d* and references to characteristics according to FIGS. 1*a*, 1*b*, 1*c* and 1*d* are made with corresponding reference numbers.

For the first group 30 of at least two first elements 301, 301', 301", 301'", an individual first element comprises at least one first edge surface 101 and at least one second edge surface 102 that are on a distance from each other, at least one slot 105, and a neck 106 with less height than the distance of the at least one first edge surface 101 and the at least one second edge surface 102. For the first group 30 of at least two first elements 301, 301', 301", 301'", the at least two first elements can be fitted at least partially together crosswise so that at least one slot 105 of at least one first element is at least partially dimensioned against a neck 106 of at least one other first element.

For the second group 31 of at least two second elements 311, 311', 311", 311'", an individual second element comprises at least one first edge surface 101 and at least one second edge surface 102 that are on a distance from each other, at least one slot 105, and a neck 106 with less height than the distance of the at least one first edge surface 101 and the at least one second edge surface 102. For the second group 31 of at least two second elements 311, 311', 311", 311'", the at least two second elements can be fitted at least partially together crosswise so that at least one slot 105 of at least one second element is at least partially dimensioned against a neck 106 of at least one other second element.

For the at least one third group 32-34 of at least two third elements, an individual third element (321, 321', 321", 321'", 331, 331', 331", 331'", 341, 341',341",341'") comprises at least one first edge surface 101 and at least one second edge surface 102 that are on a distance from each other, at least one slot 105, and a neck 106 with less height than the distance of the at least one first edge surface 101 and the at least one second edge surface 102. For the at least one third group 32-34 of at least two third elements, the at least two third elements (321321',321",321'", 331, 331', 331", 331'", 341, 341', 341", 341'", 341'") can be fitted at least partially together crosswise so that at least one slot 105 of at least one third element is at least partially dimensioned against a neck 106 of at least one other third element.

Figure 3B:
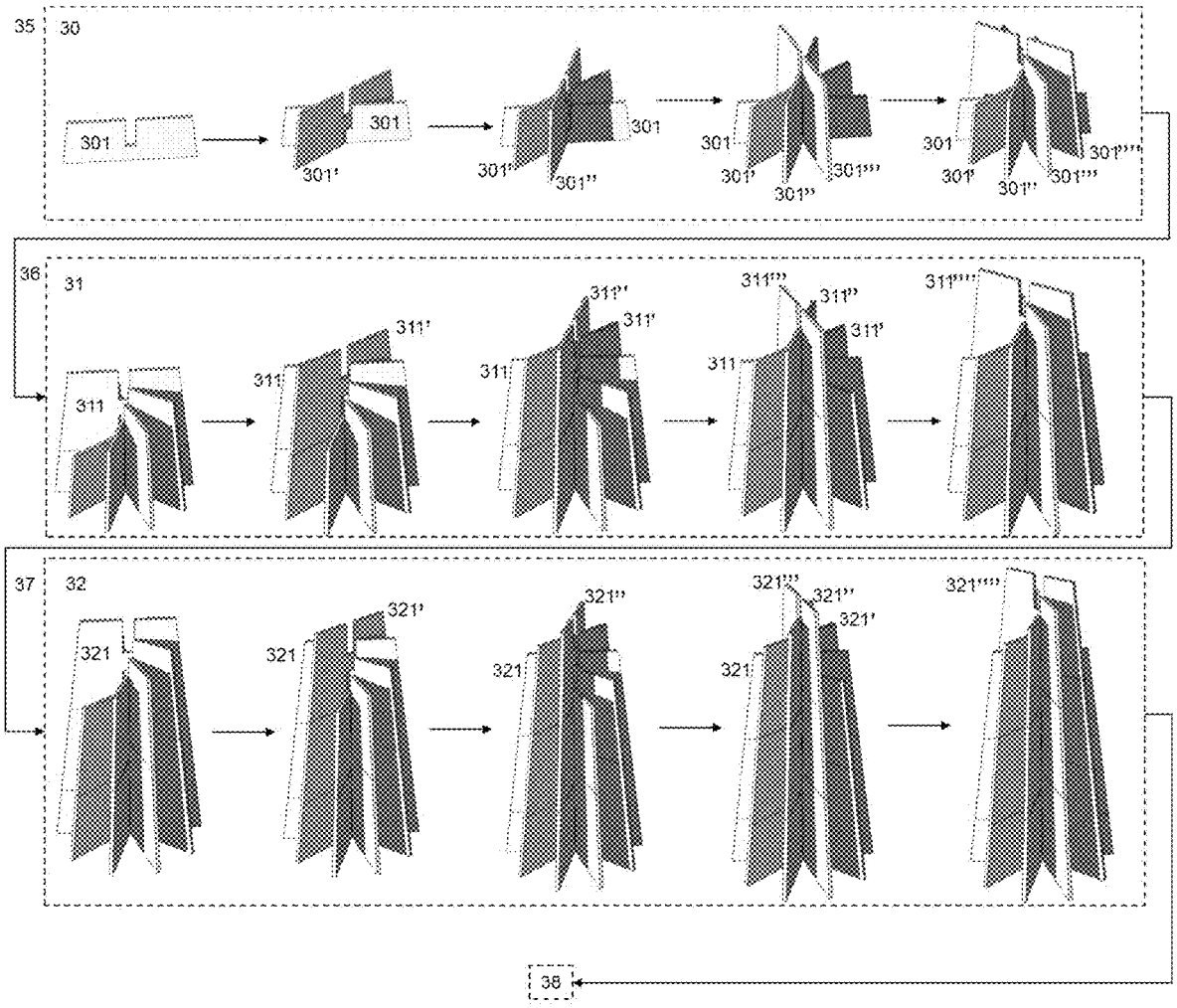
FIG. 3*b* shows another exemplary assembling of elements for an arrangement according to the invention.

FIG. 3*b* shows an exemplary assembling of elements according to FIG. 3*a* for an arrangement according to the invention. The individual first elements 301, 301' 301", 301'", 301'", second elements 311, 311', 311", 311'", 311'", and third elements 321, 321', 321", 321'", 321'", 331, 331', 331", 331'", 331'", 341, 341', 341", 341'", 341'" according to this advantageous embodiment comprise all the characteristics of individual elements 101-107 according to FIGS. 1*a*, 1*b*, 1*c* and 1*d* and references to characteristics according to FIGS. 1*a*, 1*b*, 1*c* and 1*d* are made with corresponding reference numbers.

In step 35, for the first group 30 of at least two first elements, an individual first element 301, 301', 301", 301'" comprises at least one first edge surface 101 and at least one second edge surface 102 that are on a distance from each other, at least one slot 105, and a neck 106 with less height than the distance of the at least one first edge surface 101 and the at least one second edge surface 102. For the first group 30 of at least two first elements, the at least two first elements can be fitted at least partially together crosswise so that at least one slot 105 of at least one first element is at least partially dimensioned against a neck 106 of at least one other first element. Further, the at least two first elements of first group 30 are fitted together correspondingly. For the first group 30 of at least two first elements, the at least two first elements are fitted at least partially together crosswise so that at least one slot 105 of at least one first element is at least partially dimensioned against a neck 106 of at least one other first element. The first group 30 of at least two first elements fitted together forms a layer 35 of the arrangement according to the invention.

In step 36, for the second group 31 of at least two second elements 311, an individual second element 311, 311', 311", 311'" comprises at least one first edge surface 101 and at least one second edge surface 102 that are on a distance from each other, at least one slot 105, and a neck 106 with less height than the distance of the at least one first edge surface 101 and the at least one second edge surface 102. For the second group 31 of at least two second elements, the at least two second elements can be fitted at least partially together crosswise so that at least one slot 105 of at least one second element is at least partially dimensioned against a neck 106 of at least one other second element. The at least two second elements are fitted at least partially together correspondingly.

Further, the at least two second elements 311, 311',311", 311" are fitted at least partially together crosswise so that the at least one slot 105 of at least one second element is at least partially dimensioned against the neck 106 of at least one other second element. Also, the at least one second edge surface 102 of at least one second element can be fitted at least partially against at least one first edge surface 101 of at least one first element 301, 301',301",301'". The at least one second edge surface 102 of at least one second element is fitted at least partially against at least one first edge surface 101 of at least one first element. Advantageously, the at least one second edge surface 102 of at least one second element is fitted at least partially along the length of the at least one first edge surface 101 of at least one first element. The second group 31 of at least two first elements fitted together and connected with the first group of elements 30 forms a second layer 36 of the arrangement according to the invention.

For the first group 30 of the at least two first elements 301, 301',301",301'" and the second group 31 of the at least two second elements 311, 311', 311", 311'", when fitted together according to steps 35 and 36, each group forms a layer 35-36 of the arrangement.

The first edge surfaces 101 of the at least two first elements of the first group 30 of elements and the first edge surfaces 101 of the at least two second elements of the second group 31 of elements are at least partially positioned on the same level compared to each other. Advantageously, first edge surfaces 101 of the at least two first elements of the first group of elements 30 and the first edge surfaces 101 of the at least two second elements of the second group of elements 31 may be positioned on different levels compared to each other. More advantageously, first edge surfaces 101 of the at least two firs elements of the first group of elements 30 and the first edge surfaces 101 of the at least two second elements of the second group of elements 31 are positioned on different levels compared to each other when fitted together. Also, first edge surfaces 101 of the at least two first elements of the first group of elements 30 and the first edge surfaces 101 of the at least two second elements of the second group of elements 31 may be positioned on different levels compared to each other step-wise.

According to step 37 at least one more layer 37 of third elements 321,321', 321", 321'" is added to the arrangement. For the at least one third group 32-34 of at least two third elements an individual third element (321,321',321",321"; 331,331',331",331'",331""; 341,341',341",341'",341""), comprises at least one first edge surface 101 and at least one second edge surface 102 that are on a distance from each other, at least one slot 105, and a neck 106 with less height than the distance of the at least one first edge surface 101 and the at least one second edge surface 102. For the at least one third group 32-34 of at least two third elements, the at least two third elements can be fitted at least partially together crosswise so that at least one slot 105 of at least one third element is at least partially dimensioned against a neck 106 of at least one other third element. The at least two third elements are fitted at least partially together correspondingly. Further, the at least two third elements are fitted at least partially together crosswise so that the at least one slot of 105 at least one third element is at least partially dimensioned against the neck 106 of at least one other third element. Advantageously, the at least one second edge surface 102 of at least one third element 321, 321',321",321" can be fitted at least partially against at least one first edge surface 101 of at least one second element 311, 311',311", 311'" on the previous layer 36 of the arrangement. The at least one second edge surface 102 of at least one third element is fitted at least partially against at least one first edge surface 101 of at least one first element on the previous layer 36 of the arrangement. Advantageously, the at least one second edge surface 102 of at least one third element is fitted at least partially along the length of the at least one first edge surface 101 of at least one second element on the previous layer 36 of the arrangement.

The first edge surfaces 101 of the at least two first elements 301301',301",301" of the first group of elements 30, the first edge surfaces 101 of the at least two second elements 311,311',311",311'" of the second group of elements 31 and the first edge surfaces 101 of the at least two third elements 321,321',321",321'" of the at least one third group of elements 32 are at least partially positioned on the same level compared to each other. Advantageously, first edge surfaces 101 of the at least two first elements of the first group of elements 30, the first edge surfaces 101 of the at least two second elements of the second group of elements 31 and the first edge surfaces 101 of the at least two third elements of the at least one third group of elements 32 may be positioned on different levels compared to each other. Also, first edge surfaces 101 of the at least two first elements of the first group 30 of elements 30, the first edge surfaces 101 of the at least two second elements 311 of the second group of elements 31 and the first edge surfaces 101 of the at least two third elements and 321' of the at least one third group of elements 32 may be positioned on different levels compared to each other step-wise.

Figure 3C:
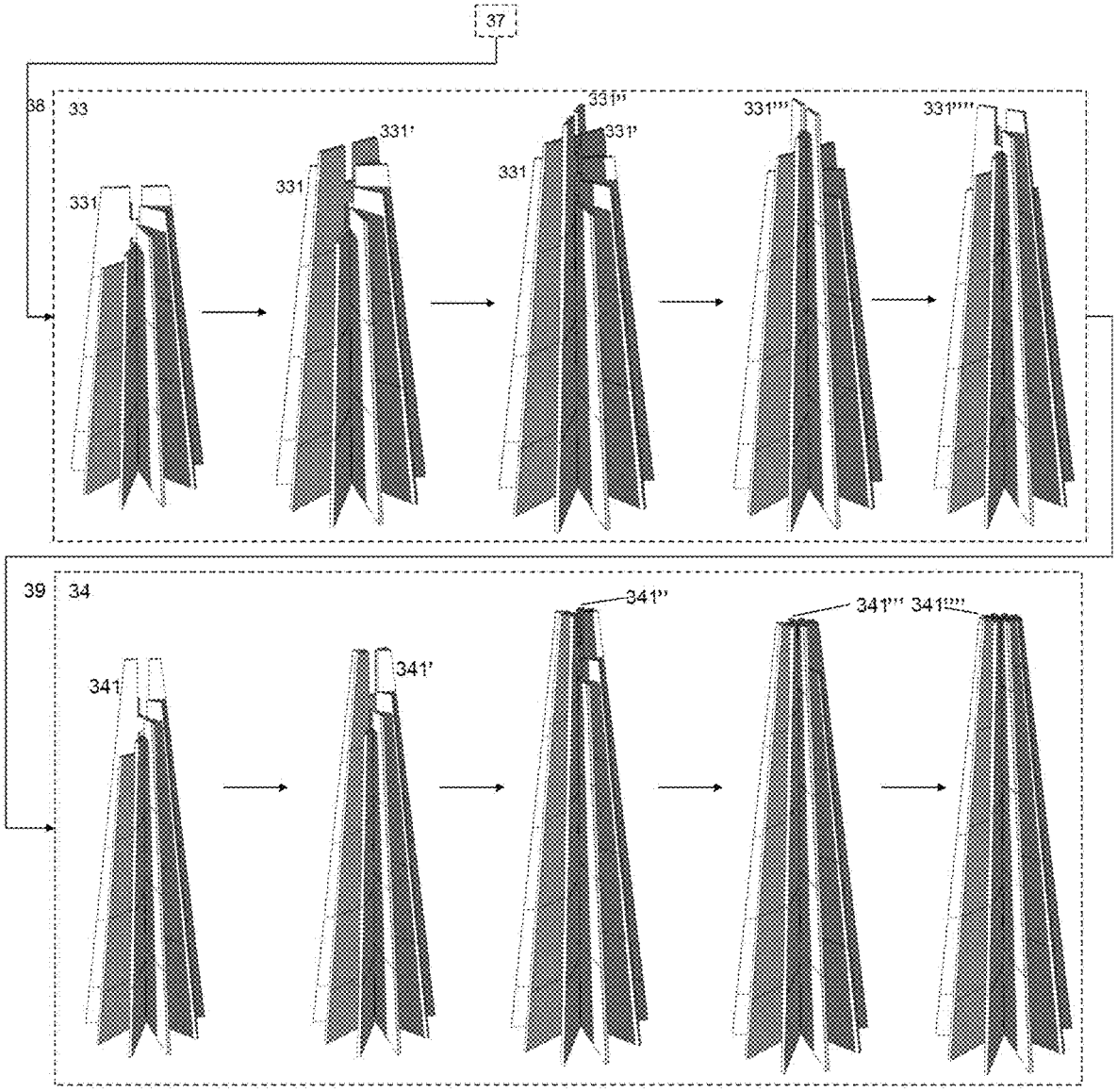
FIG. 3*c* is a continuation for FIG. 3*b* and shows another exemplary assembling of elements for an arrangement according to the invention.

FIG. 3*c* is a continuation for FIG. 3*b* shows an exemplary assembling of elements according to FIG. 3*a* for an arrangement according to the invention. Step 38 continues from step 37 of FIG. 3*b*.

According to step 38 at least one more layer 38 of third elements is added to the arrangement similarly to step 37. The at least two third elements 331, 331', 331", 331'" are fitted at least partially together crosswise so that the at least one slot of 105 at least one third element is at least partially dimensioned against the neck 106 of at least one other third element. Also, the at least one second edge surface 102 of at least one third element can be fitted at least partially against at least one first edge surface 101 of at least one second element on the previous layer 37 of the arrangement. Further, the at least one second edge surface 102 of at least one third element is fitted at least partially against at least one first edge surface 101 of at least one second element on the previous layer 37 of the arrangement. Further, the at least one second edge surface 102 of at least one third element is fitted at least partially along the length of the at least one first edge surface 101 of at least one second element on the previous layer 37 of the arrangement.

The first edge surfaces 101 of the at least two first elements 301301',301", 301'" of the first group of elements 30, the first edge surfaces 101 of the at least two second elements 311, 311', 311", 311'" of the second group-of elements 31 and the first edge surfaces 101 of the at least two third elements (321,321', 321",321'", and 331, 331',331", 331'") of the at least one third group of elements (32, and 33 respectively) are at least partially positioned on the same level compared to each other. Advantageously, first edge surfaces 101 of the at least two first elements of the first group of elements 30, the first edge surfaces 101 of the at least two second elements of the second group of elements 31 and the first edge surfaces 101 of the at least two third elements of the at least one third group of elements (32, 33) may be positioned on different levels compared to each other. Also, first edge surfaces 101 of the at least two first elements of the first group of elements 30, the first edge surfaces 101 of the at least two second elements of the second group of elements 31 and the first edge surfaces 101 of the at least two third elements of the at least one third group of elements (32, 33) may be positioned on different levels compared to each other step-wise.

According to step 39 at least one more layer 39 of third elements 341, 341', 341", 341'" is added to the arrangement similarly to steps 37 and 38. The at least two third elements are fitted at least partially together crosswise so that the at least one slot of 105 at least one third element is at least partially dimensioned against the neck 106 of at least one other third element. Also, the at least one second edge surface 102 of at least one third element can be fitted at least partially against at least one first edge surface 101 of at least one third element 331, 331', 331", 331'" on the previous layer 38 of the arrangement. Further, the at least one second edge surface 102 of at least one third element is fitted at least partially against at least one first edge surface 101 of at least one third element on the previous layer 38 of the arrangement. Also, the at least one second edge surface 102 of at least one third element is fitted at least partially along the length of the at least one first edge surface 101 of at least one third element on the previous layer 38 of the arrangement.

According to step 39 the added third groups 32-34 of the at least two third elements, when fitted together according to steps 37-39, form a layer 37-39 of the arrangement.

According to step 39 the first edge surfaces 101 of the at least two first elements of the first group of elements 30, the first edge surfaces 101 of the at least two second elements of the second group of elements 31, and the first edge surfaces 101 of the at least two third elements of the at least one third group of elements (32, 33, 34) are at least partially positioned on the same level compared to each other. Advantageously, first edge surfaces 101 of the at least two firs elements of the first group of elements 30, the first edge surfaces 101 of the at least two second elements of the second group of elements 31 and the first edge surfaces 101 of the at least two third elements of the at least one third group of elements (32, 33, 34) may be positioned on different levels compared to each other. Also, first edge surfaces 101 of the at least two first elements of the first group of elements 30, the first edge surfaces 101 of the at least two second elements of the second group of elements 31 and the first edge surfaces 101 of the at least two third elements of the at least one third group of elements (32, 33, 34) may be positioned on different levels compared to each other step-wise.

According to step 39, more advantageously, the first edge surfaces 101 of the at least two first elements (301, 301', 301", 301'"), the at least two second elements (311, 311', 311", 311'"), the at least two third elements (321,321',321", 321'"; 331, 331', 331",331'"; 341, 341',341",341'") of at least one group of elements (30, 31, 32, 33, 34), respectively are at least partially positioned on the same level compared to each other. Also more advantageously, the first edge surfaces 101 of the at least two first elements, at least two second elements, at least two third elements of at least one group of elements (30, 31, 32, 33, 34) respectively are positioned on different levels compared to each other when fitted together. Finally, the first edge surfaces 101 of the at least two elements of at least one group of elements (30, 31, 32, 33, 34) are positioned on different levels compared to each other step-wise. Also advantageously, the first edge surfaces (101) of the at least two elements of at least one group of elements (20-22, 30-34) are at least partially positioned according to at least one of the following: on the same level compared to each other when fitted together and on different levels compared to each other when fitted together.

Very advantageously, the individual elements of one group (20-22, 30-34) of at least two elements are fitted at least partially together crosswise so that the at least one slot (105) of at least one individual element is at least partially dimensioned against the neck (106) of at least one other individual element of the same group of at least two elements (20-25, 30-39). Further, the at least one second edge surface (102) of at least one individual second or third element is fitted at least partially against at least one first edge surface (101) of at least one individual first, second or third element on the previous layer (23-25, 35-39) of the arrangement.

Figure 4A:
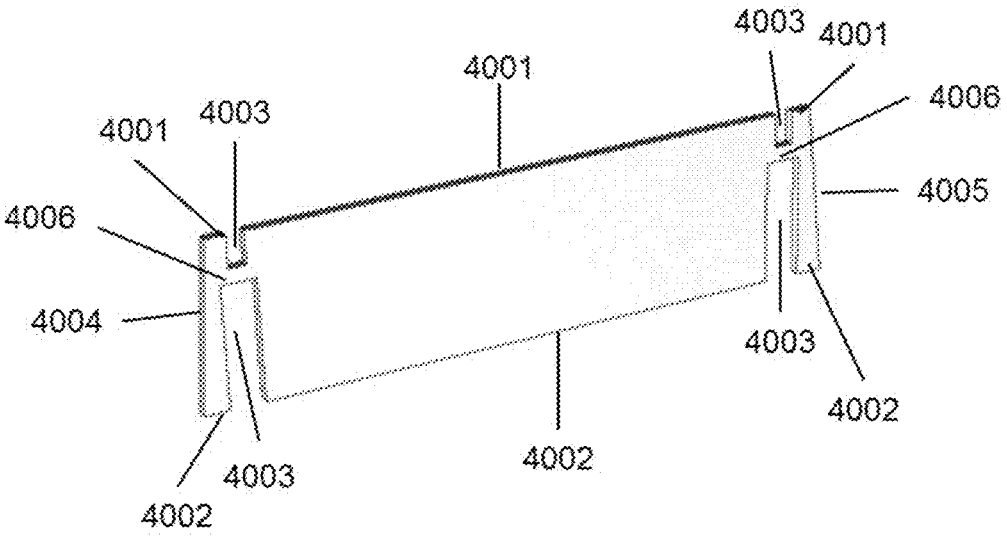
FIG. 4*a* shows an exemplary connection element according to the invention.

FIG. 4*a* shows an exemplary connection element according to the invention. A connection element is an element adapted to connect at least two arrangements according to the invention with each other. A connection element may replace an individual element of any of the previous embodiments.

A connection element comprises a first 4004 end, a second end 4005, at least one first edge surface 4001, at least one second edge surface 4002, at least two slots 4003 and at least two necks 4006.

More advantageously, the connection element comprises a first 4004 end, a second end 4005, at least one first edge surface 4001 and at least one second edge surface 4002 that are on a distance from each other between the first end 4004 and the second end 4005, and at least one slot 4003 substantially on the first end 4004 at least one other slot 4003 substantially on the second end 4005 and the said at least two slots 4003 are extending from the at least one first edge surface 4001 and/or from the at least one second edge surface 4002 towards at least one neck 4006 with less height than the distance of the at least one first edge surface 4001 and the at least one second edge surface 4002.

The at least one first edge surface 4001 and the at least one second edge surface 4002 are on distance from each other. The at least one first edge surface 4001 and the at least one second edge surface 4002 are on distance from each other and the distance is substantially defined by the length of the first end 4004 and the second end 4005. The first end 4004 and second end 4005 are on distance from each other. The first end 4004 and second end 4005 are on distance from each other and the distance is substantially defined by at least the length of the at least one first edge surface 4001 and the at least one second edge surface 4002.

The at least one slot 4003 may extend from the at least one first edge surface 4001 towards the inner parts of the connection element. Advantageously, the at least one slot 4003 may extend from the at least one first edge surface 4001 towards the inner parts of the connection element to at least one neck 4006 of the connection element. The at least one slot 4003 extend from the at least one second edge surface 4002 towards the inner parts of the connection element. Advantageously, the at least one slot 4003 extends from the at least one second edge surface 4002 towards the inner parts of the connection element to at least one neck 4006 of the connection element. The at least one slot 4003 may extend from the at least one first edge surface 4001 or the at least one second edge surface 4002 towards the inner parts of the connection element. The at least one slot 4003 may extend from the at least one first edge surface 4001 or the at least one second edge surface 4002 towards the inner parts of the connection element to at least one neck 4006 of the connection element.

The length of the at least one slot 4003 is less than the length of the first end 4004. Also, the length of the at least one slot 4003 is less than the length of the second end 4005. The length of the at least one slot 4003 is less than the length of the first end 4004 or the length of the second end 4005. The length of at least two opposite slots 4003 substantially on the first end 4004 is less than the length of the first end 4004. The length of at least two opposite slots 4003 substantially on the second end 4005 is less than the length of the second end 4005. The length of at least two opposite slots 4003 is less than distance of the at least one first edge surface 4001 and the at least one second edge surface 4002.

The height of the at least one neck 4006 is less than the distance of the at least one first edge surface 4001 and the at least one second edge surface 4002. The height of the at least one neck 4006 is less than the length of the first end 4004. The height of the at least one neck 4006 is less than the length of the second 4005. The width of the at least one neck 4006 substantially on the first end 4004 is at most the width of the widest slot 4003 substantially on the first end 4004 of the connection element. The width of the at least one neck 4006 substantially on the second end 4005 is at most the width of the widest slot 4003 substantially on the second end 4005 of the connection element.

Figure 4B:
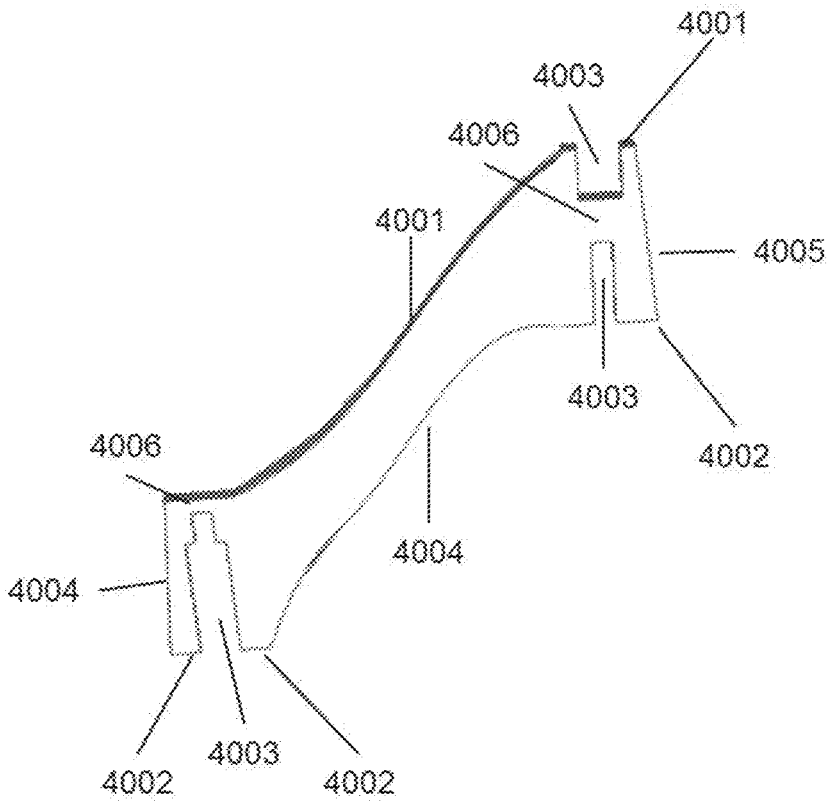
FIG. 4*b* shows another exemplary connection element according to the invention.

FIG. 4*b* shows another exemplary connection element according to the invention. A connection element is an element adapted to connect at least two arrangements according to the invention with each other. A connection element may replace an individual element of any of the previous embodiments.

A connection element comprises a first 4004 end, a second end 4005, at least one first edge surface 4001, at least one second edge surface 4002, at least two slots 4003 and at least two necks 4006.

More advantageously, the connection element comprises a first 4004 end, a second end 4005, at least one first edge surface 4001 and at least one second edge surface 4002 that are on a distance from each other between the first end 4004 and the second end 4005, and at least one slot 4003 substantially on the first end 4004 at least one other slot 4003 substantially on the second end 4005 and the said at least two slots 4003 are extending from the at least one first edge surface 4001 and/or from the at least one second edge surface 4002 towards at least one neck 4006 with less height than the distance of the at least one first edge surface 4001 and the at least one second edge surface 4002.

The at least one first edge surface 4001 and the at least one second edge surface 4002 are on distance from each other. Advantageously, the at least one first edge surface 4001 and the at least one second edge surface 4002 are on distance from each other and the distance is substantially defined by the length of the first end 4004 and the second end 4005.

Advantageously, the at least one first edge surface 4001 may at least partially curve substantially from the first end 4004 towards the second end 4005. Also advantageously, the at least one second edge surface 4002 may at least partially curve substantially from the first end 4004 towards the second end 4005. Advantageously, the at least one first edge surface 4001 and the at least one second edge surface 4002 are on distance from each other and the distance is substantially defined by the length of the first end 4004 and the second end 4005 but may be less than the length of the first end 4004 or the second end 4005 when the at least one first edge surface 4001 or the at least one second edge surface 4002 is at least partially curved substantially from the first end 4004 towards the second end 4005.

The first end 4004 and second end 4005 are on distance from each other. The first end 4004 and second end 4005 are on distance from each other and the distance is substantially defined by at least the length of the at least one first edge surface 4001 and the at least one second edge surface 4002.

The at least one slot 4003 may extend from the at least one first edge surface 4001 towards the inner parts of the connection element. Advantageously, the at least one slot 4003 may extend from the at least one first edge surface 4001 towards the inner parts of the connection element to at least one neck 4006 of the connection element. The at least one slot 4003 extend from the at least one second edge surface 4002 towards the inner parts of the connection element. Advantageously, the at least one slot 4003 extends from the at least one second edge surface 4002 towards the inner parts of the connection element to at least one neck 4006 of the connection element. The at least one slot 4003 may extend from the at least one first edge surface 4001 or the at least one second edge surface 4002 towards the inner parts of the connection element. The at least one slot 4003 may extend from the at least one first edge surface 4001 or the at least one second edge surface 4002 towards the inner parts of the connection element to at least one neck 4006 of the connection element.

The length of the at least one slot 4003 is less than the length of the first end 4004. Also, the length of the at least one slot 4003 is less than the length of the second end 4005. The length of the at least one slot 4003 is less than the length of the first end 4004 or the length of the second end 4005. The length of at least two opposite slots 4003 substantially on the first end 4004 is less than the length of the first end 4004. The length of at least two opposite slots 4003 substantially on the second end 4005 is less than the length of the second end 4005. The length of at least two opposite slots 4003 is less than distance of the at least one first edge surface 4001 and the at least one second edge surface 4002.

The height of the at least one neck 4006 is less than the distance of the at least one first edge surface 4001 and the at least one second edge surface 4002. The height of the at least one neck 4006 is less than the length of the first end 4004. The height of the at least one neck 4006 is less than the length of the second end 4005. The width of the at least one neck 4006 substantially on the first end 4004 is at most the width of the widest slot 4003 substantially on the first end 4004 of the connection element. The width of the at least one neck 4006 substantially on the second end 4005 is at most the width of the widest slot 4003 substantially on the second end 4005 of the connection element.

Figure 4C:
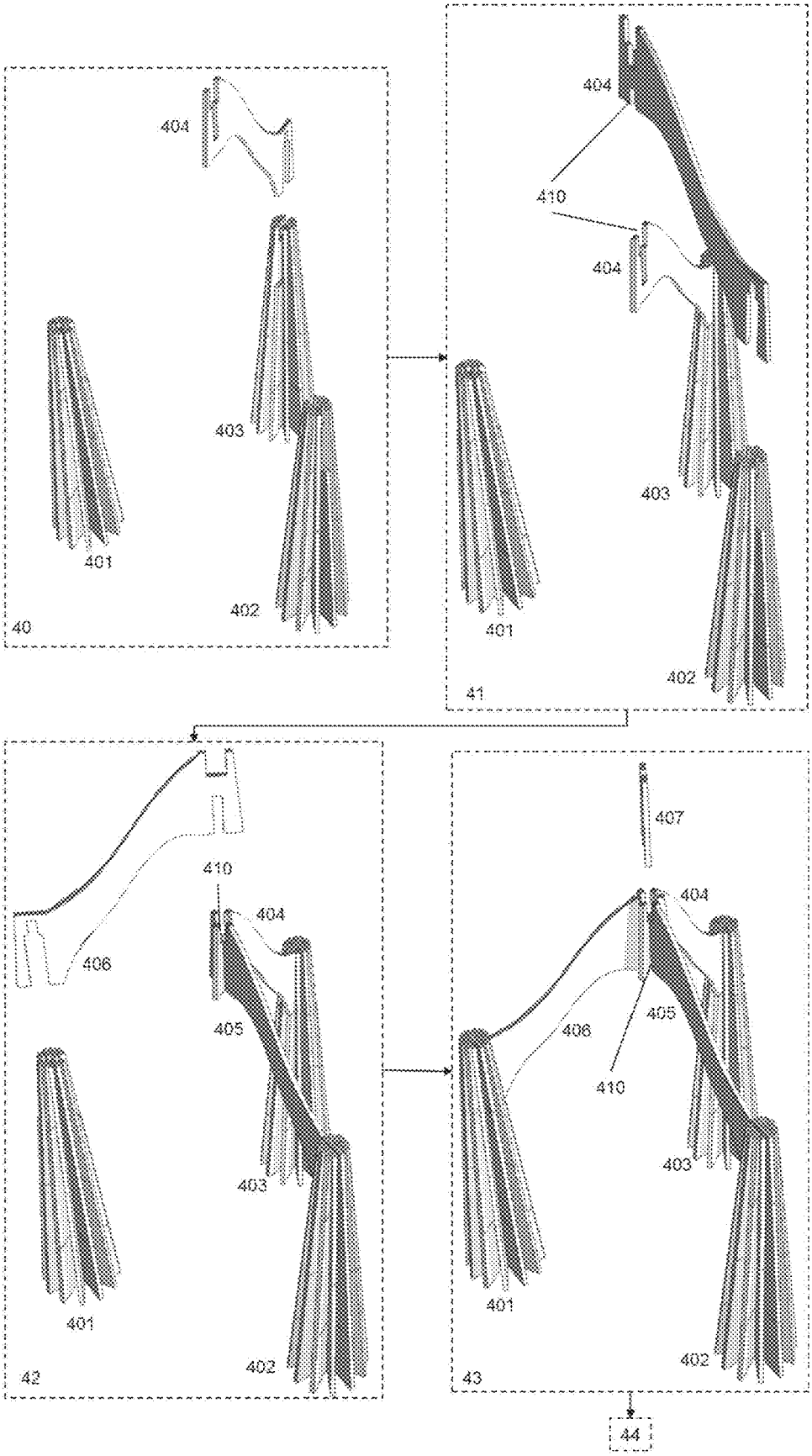
FIG. 4*c* shows an exemplary application of a connection element.

FIG. 4*c* shows an exemplary application of a connection element. FIG. 4*c* is continued in FIG. 4*d*. In this exemplary embodiment there is at least one connection element 404 that has all the characteristics 4001-4007 according to FIGS. 4*a* and 4*b* and references to such characteristics 4001-4007 are made when needed.

According to steps 40-46, for each of the at least two arrangements 401-403 at least one individual element according to FIGS. 1*a*-1*d* of at least one group (20-22 according to FIGS. 2*a*-2*b* and 30-34 according to FIGS. 3*a*-3*b*) of at least two elements is adapted to be a connection element 404-406 that connects at least two arrangements 401-403 with each other.

In step 40 at least two arrangements according to the invention 401-403 are to be connected with each other by adding at least one connection element 404. At least one individual element according to FIGS. 1*a*-1*d* of at least one group (20-22 according to FIGS. 2*a*-2*b* and 30-34 according to FIGS. 3*a*-3*b*) on at least one arrangement 403 is adapted to be a connection element 404 that connects at least two arrangements 401-403 with each other. At least one individual element according to FIGS. 1*a*-1*d* of at least one group (20-22 according to FIGS. 2*a*-2*b* and 30-34 according to FIGS. 3*a*-3*b*) on at least one arrangement 403 is replaced by a connection element 404 that enables at least two arrangements 401-403 to be connected with each other.

The at least one connection element 404 can be fitted at least partially together crosswise with at least one other individual element according to FIGS. 1*a*-1*d* of at least one group (20-22 according to FIGS. 2*a*-2*b* and 30-34 according to FIGS. 3*a*-3*b*) of at least two elements so that the at least one slot 4003 (FIGS. 4*a*-4*b*) of the at least one connection element 404 in either end of the connection element 4004-4005 is at least partially dimensioned against the neck 106 of the at least one other individual element according to FIGS. 1*a*-1*d* of at least one group (20-22 according to FIGS. 2*a*-2*b* and 30-34 according to FIGS. 3*a*-3*b*) of at least two elements in the at least one arrangement 403.

The at least one connection element 404 is fitted at least partially together with at least one other individual element according to FIGS. 1*a*-1*d* of at least one group (20-22 according to FIGS. 2*a*-2*b* and 30-34 according to FIGS. 3*a*-3*b*) of at least two elements correspondingly. The at least one connection element 404 is fitted at least partially together crosswise with at least one other individual element according to FIGS. 1*a*-1*d* of at least one group (20-22 according to FIGS. 2*a*-2*b* and 30-34 according to FIGS. 3*a*-3*b*) of at least two elements so that the at least one slot 4003 (FIGS. 4*a*-4*b*) of the at least one connection element 404 in either end of the connection element 4004-4005 is at least partially dimensioned against the neck 106 of the at least one other individual element according to FIGS. 1*a*-1*d* of at least one group (20-22 according to FIGS. 2*a*-2*b* and 30-34 according to FIGS. 3*a*-3*b*) of at least two elements in the at least one arrangement 403.

The at least one connection element 404 is fitted at least partially together crosswise with at least one other individual element according to FIGS. 1*a*-1*d* of at least one group (20-22 according to FIGS. 2*a*-2*b* and 30-34 according to FIGS. 3*a*-3*b*) of at least two elements so that the at least one slot 4003 (FIGS. 4*a*-4*b*) of the at least one connection element 404 in the first end 4004 or the second end 4005 of the connection element is at least partially dimensioned against the neck 106 of the at least one other individual element according to FIGS. 1*a*-1*d* of at least one group (20-22 according to FIGS. 2*a*-2*b* and 30-34 according to FIGS. 3*a*-3*b*) of at least two elements in the at least one arrangement 403.

In step 41 connecting the at least two arrangements according to the invention 401-403 with each other is continued by adding at least one other connection element 405. At least one individual element according to FIGS. 1*a*-1*d* of at least one group (20-22 according to FIGS. 2*a*-2*b* and 30-34 according to FIGS. 3*a*-3*b*) on at least one arrangement 402 is adapted to be a connection element 405 that connects at least two arrangements 401-403 with each other. At least one individual element according to FIGS. 1*a*-1*d* of at least one group (20-22 according to FIGS. 2*a*-2*b* and 30-34 according to FIGS. 3*a*-3*b*) on at least one arrangement 402 is replaced by a connection element 405 that enables at least two arrangements 401-403 to be connected with each other.

Further in step 41, the at least one connection element 405 is fitted at least partially together crosswise with at least one other individual element according to FIGS. 1*a*-1*d* of at least one group (20-22 according to FIGS. 2*a*-2*b* and 30-34 according to FIGS. 3*a*-3*b*) of at least two elements so that the at least one slot 4003 (FIGS. 4*a*-4*b*) of the at least one connection element 405 in either end of the connection element 4004-4005 is at least partially dimensioned against the neck 106 of the at least one other individual element according to FIGS. 1*a*-1*d* of at least one group (20-22 according to FIGS. 2*a*-2*b* and 30-34 according to FIGS. 3*a*-3*b*) of at least two elements in the at least one arrangement 402.

The at least one connection element 405 is fitted at least partially together crosswise with at least one other individual element according to FIGS. 1*a*-1*d* of at least one group (20-22 according to FIGS. 2*a*-2*b* and 30-34 according to FIGS. 3*a*-3*b*) of at least two elements so that the at least one slot 4003 (FIGS. 4*a*-4*b*) of the at least one connection element 405 in the first end 4004 or the second end 4005 of the connection element is at least partially dimensioned against the neck 106 of the at least one other individual element according to FIGS. 1*a*-1*d* of at least one group (20-22 according to FIGS. 2*a*-2*b* and 30-34 according to FIGS. 3*a*-3*b*) of at least two elements in the at least one arrangement 402.

Finally in step 41, the at least one connection element 405 is fitted together with at least one other connection element 404 by dimensioning at least partially at least one slot 4003 of either of the at least two connection elements 404-405 against at least one neck 4006 of the other of the at least two connection elements 404-405 forming at least one crossing point 410.

In step 42 connecting the at least two arrangements according to the invention 401-403 with each other is further continued by adding at least one other connection element 406. At least one individual element according to FIGS. 1*a*-1*d* of at least one group (20-22 according to FIGS. 2*a*-2*b* and 30-34 according to FIGS. 3*a*-3*b*) on at least one arrangement 401 is adapted to be a connection element 406 that connects at least two arrangements 401-403 with each other. At least one individual element according to FIGS. 1*a*-1*d* of at least one group (20-22 according to FIGS. 2*a*-2*b* and 30-34 according to FIGS. 3*a*-3*b*) on at least one arrangement 401 is replaced by a connection element 406 that enables at least two arrangements 401-403 to be connected with each other.

Further in step 42, the at least one connection element 406 is fitted at least partially together crosswise with at least one other individual element according to FIGS. 1*a*-1*d* of at least one group (20-22 according to FIGS. 2*a*-2*b* and 30-34 according to FIGS. 3*a*-3*b*) of at least two elements so that the at least one slot 4003 (FIGS. 4*a*-4*b*) of the at least one connection element 406 in either end of the connection element 4004-4005 is at least partially dimensioned against the neck 106 of the at least one other individual element according to FIGS. 1*a*-1*d* of at least one group (20-22 according to FIGS. 2*a*-2*b* and 30-34 according to FIGS. 3*a*-3*b*) of at least two elements in the at least one arrangement 401.

The at least one connection element 406 is fitted at least partially together crosswise with at least one other individual element according to FIGS. 1*a*-1*d* of at least one group (20-22 according to FIGS. 2*a*-2*b* and 30-34 according to FIGS. 3*a*-3*b*) of at least two elements so that the at least one slot 4003 (FIGS. 4*a*-4*b*) of the at least one connection element 406 in the first end 4004 or the second end 4005 of the connection element is at least partially dimensioned against the neck 106 of the at least one other individual element according to FIGS. 1*a*-1*d* of at least one group (20-22 according to FIGS. 2*a*-2*b* and 30-34 according to FIGS. 3*a*-3*b*) of at least two elements in the at least one arrangement 401.

Finally in step 42, the at least one connection element 406 is fitted together with at least one other connection element 404-405 by dimensioning at least partially at least one slot 4003 of either of the at least two connection elements 404-406 against at least one neck 4006 of the other of the at least two connection elements 404-406 forming at least one crossing point 410.

In step 43, the at least one connection element 404-406 is further fitted together with at least one other connection element 404-406 by at least one joint part 407 that comprises all the characteristics 101-107 of an individual element according to FIGS. 1*a*-1*d*. The at least one connection element 404-406 is further fitted together with at least one other connection element 404-406 by at least one joint part 407 comprising at least one first edge surface 101 and at least one second edge surface 102 that are on a distance from each other, at least one slot 105, and a neck 106 with less height than the distance of the at least one first edge surface 101 and the at least one second edge surface 102. Further, the at least one slot 105 of the at least one joint part 407 is at least partially dimensioned against the crossing point 410 of the at least two connection elements 404-406. Advantageously, the at least one slot 105 of the at least one joint 407 part is at least partially dimensioned to the crossing point 410 of the at least two connection elements 404-406 and at least partially against at least one neck 4006 of at least one connection element 404-406.

Figure 4D:
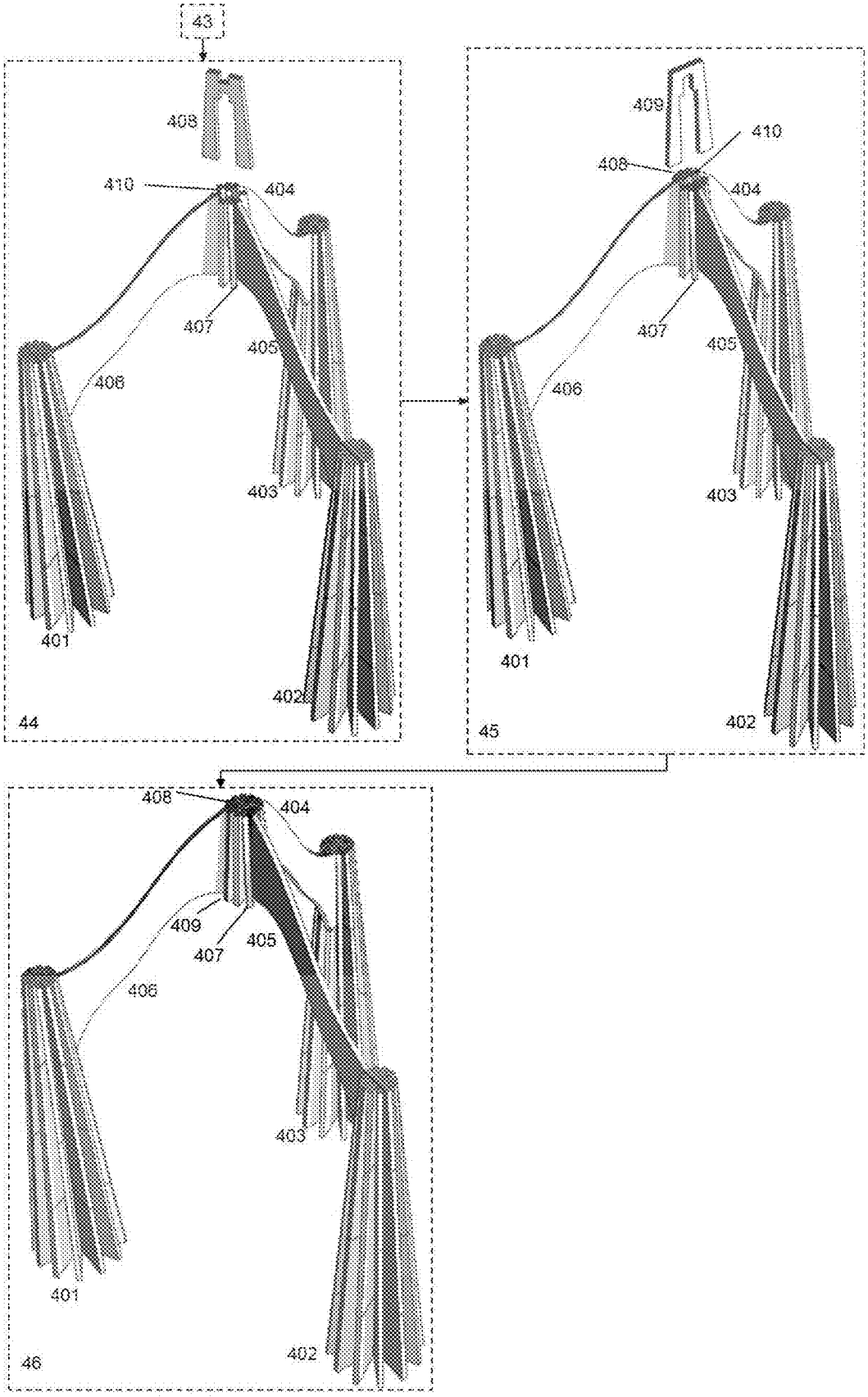
FIG. 4*d* is continuation for FIG. 4*c* and shows an exemplary application of a connection element.

FIG. 4*d* is continuation for FIG. 4*c* and shows an exemplary application of a connection element.

Step 44 continues from step 43 of FIG. 4*c*. In step 44, the at least one connection element 404-406 is further fitted together with at least one other connection element 404-406 by at least one other joint part 408 that comprises all the characteristics 101-107 of an individual element according to FIGS. 1*a*-1*d*. The at least one connection element 404-406 is further fitted together with at least one other at least one other joint part 408 comprising at least one first edge surface 101 and at least one second edge surface 102 that are on a distance from each other, at least one slot 105, and a neck 106 with less height than the distance of the at least one first edge surface 101 and the at least one second edge surface 102. Further, the at least one slot 105 of the at least one joint part 408 is at least partially dimensioned against the crossing point 410 of the at least two connection elements 404-406 and at least one other previously added joint part 407 so that at least one slot 105 of at least one joint part 407-408 is at least partially dimensioned against the neck 106 of the another at least one joint part 407-408. The at least one slot 105 of the at least one joint part 408 may also be at least partially dimensioned against the crossing point 410 of the at least two connection elements 404-406 and at least one other previously added joint part 407 so that at least one slot 105 of at least one joint part 407-408 is at least partially dimensioned against the neck 106 of the another at least one joint part 407-408 or the at least one neck 4006 of the at least one connection element 404-406. [000121] In step 45, the at least one connection element 404-406 is further fitted together with at least one other connection element 404-406 by at least one other joint part 409 that comprises all the characteristics 101-107 of an individual element according to FIGS. 1*a*-1*d*. The at least one connection element 404-406 is further fitted together with at least one other at least one other joint part 409 comprising at least one first edge surface 101 and at least one second edge surface 102 that are on a distance from each other, at least one slot 105, and a neck 106 with less height than the distance of the at least one first edge surface 101 and the at least one second edge surface 102. Further, the at least one slot 105 of the at least one joint 409 part is at least partially dimensioned against the crossing point 410 of the at least two connection elements 404-406 and at least one other previously added joint part 407-408 so that at least one slot 105 of at least one joint part 409 is at least partially dimensioned against the neck 106 of the another at least one previously added joint part 407-408.

Advantageously, the at least one slot 105 of the at least one joint 409 part is at least partially dimensioned to the crossing point 410 of the at least two connection elements 404-406 and at least partially against at least one neck 4006 of at least one connection element 404-406. Also advantageously, the at least one slot 105 of the at least one joint part 409 is at least partially dimensioned to the crossing point 410 of the at least two connection elements 404-406 and at least partially against at least one neck 4006 of at least one connection element 404-407 or the neck of the at least one previously added joint part 407-408.

Finally, in step 46, the at least two arrangements 401-403 are connected with each other.

Figure 5:
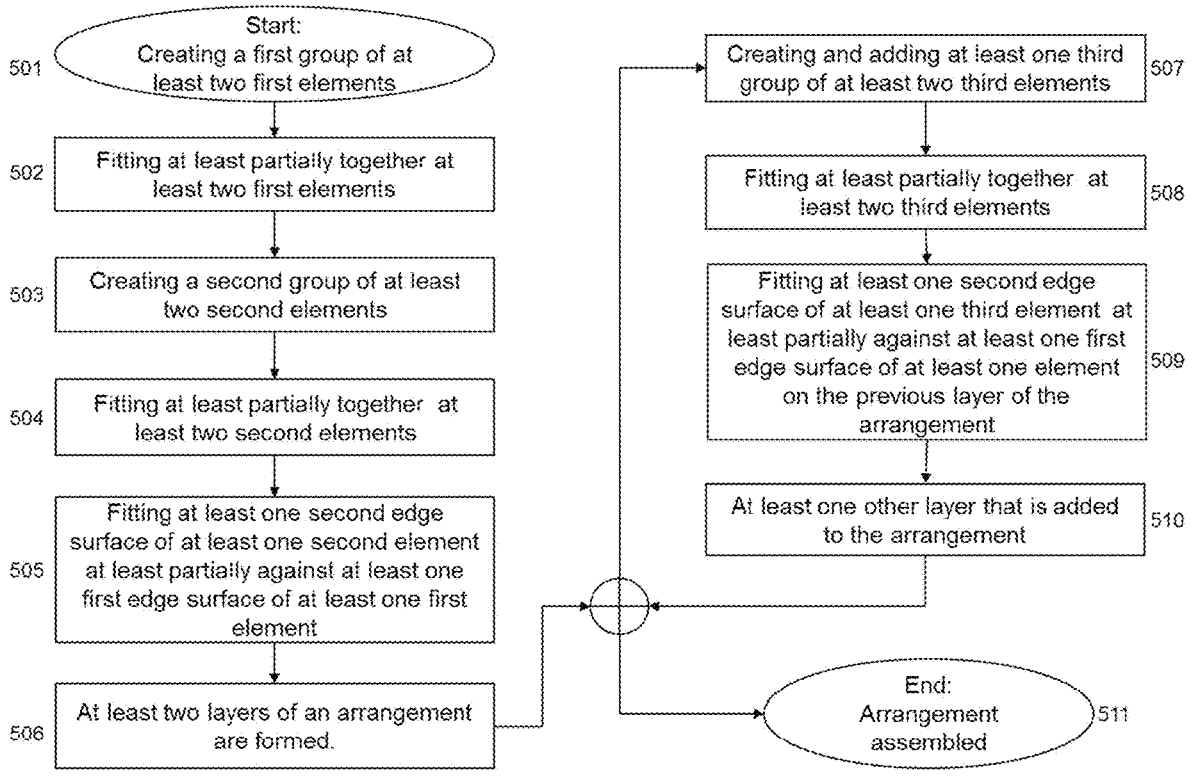
FIG. 5 shows exemplary method steps according to the invention.

FIG. 5 shows exemplary method steps according to the invention. References to previous FIGS. 1*a*-4*d* are made as required to describe the invention.

A method for assembling an arrangement according to the invention is started in step 501 by creating a first group (20, 30) of at least two first elements. In step 501 a first group (20, 30) of at least two first elements, where an individual first element comprises all the characteristics of an individual element according FIGS. 1 *a*-1*d*, is created. The first group (20, 30) of at least two first elements (201, 301) is created and an individual first element comprises at least one first edge surface 101 and at least one second edge surface 102 that are on a distance from each other, at least one slot 105, and a neck 106 with less height than the distance of the at least one first edge surface 101 and the at least one second edge surface 102. The at least two first elements of the first group (20, 30) can be fitted at least partially together crosswise so that at least one slot 105 of at least one first element is at least partially dimensioned against a neck 106 of at least one other first element.

According to step 502 the at least two first elements of first group (20, 30) are fitted together correspondingly. For the first group (20, 30) of at least two first elements, the at least two first elements are fitted at least partially together crosswise so that at least one slot 105 of at least one first element is at least partially dimensioned against a neck 106 of at least one other first element. The first group (20, 30) of at least two first elements fitted together forms a layer (23, 35) of the arrangement according to the invention.

More advantageously, according to step 502, the method comprises fitting the individual elements of one group (20-22, 30-34) of at least two elements at least partially together crosswise so that the at least one slot (105) of at least one individual element is at least partially dimensioned against the neck (106) of at least one other individual element of the same group of at least two elements (20-25, 30-39).

In step 503 a second group (21, 31) of at least two second elements is created. The second group (21, 31) of at least two second elements is created and an individual second element comprises at least one first edge surface 101 and at least one second edge surface 102 that are on a distance from each other, at least one slot 105, and a neck 106 with less height than the distance of the at least one first edge surface 101 and the at least one second edge surface 102. For the second group (21, 31) of at least two second elements, the at least two second elements can be fitted at least partially together crosswise so that at least one slot 105 of at least one second element is at least partially dimensioned against a neck 106 of at least one other second element.

In step 504 the at least two second elements are fitted at least partially together correspondingly. Further, the at least two second elements are fitted at least partially together crosswise so that the at least one slot 105 of at least one second element is at least partially dimensioned against the neck 106 of at least one other second element. The at least two second elements are fitted at least partially together crosswise so that the at least one slot 105 of at least one second element is at least partially dimensioned against the neck 106 of at least one other second element and the at least one slot 105 of at least one second element is dimensioned at least partly crosswise and opposite to the at least one slot 105 of at least one other second element.

More advantageously, according to step 504, the method further comprises fitting the individual elements of one group (20-22, 30-34) of at least two elements at least partially together crosswise together so that the at least one slot (105) of at least one individual element is at least partially dimensioned against the neck (106) of at least one other individual element of the same group of at least two elements (20-25, 30-39).

In step 505 the at least one second edge surface 102 of at least one second element is fitted at least partially against at least one first edge surface 101 of at least one first element. Advantageously, the at least one second edge surface 102 of at least one second element is fitted at least partially along the length of the at least one first edge surface 101 of at least one first element. The second group (21, 31) of at least two first elements (211, 311) is fitted together and connected with the first group of elements (20, 30) forming a second layer (24, 36) of the arrangement according to the invention.

More advantageously, according to step 505, the method further comprises fitting at least one second edge surface (102) of at least one individual second or third element at least partially against at least one first edge surface (101) of at least one individual first, second or third element on the previous layer (23-25, 35-39) of the arrangement.

According to step 506 fitting together the first group (20, 30) of the at least two first elements (201, 301) and the second group (21, 31) of the at least two second elements according to previous steps causes that each group (20, 30, 21, 31) forms a layer (23-24, 35-36) of the arrangement.

When fitted together, the first edge surfaces 101 of the at least two elements of the first group (20, 30) of elements and the first edge surfaces 101 of the at least two elements of the second group (21, 31) of elements are at least partially positioned on the same level compared to each other. Advantageously, when fitted together, the first edge surfaces 101 of the at least two elements of the first group (20, 30) of elements and the first edge surfaces 101 of the at least two elements of the second group (21, 31) of elements may be positioned on different levels compared to each other. When fitted together, the first edge surfaces 101 of the at least two elements of the first group (20, 30) of elements and the first edge surfaces 101 of the at least two elements of the second group (21, 31) of elements are positioned on different levels compared to each other. Also, first edge surfaces 101 of the at least two elements of the first group (20, 30) of elements and the first edge surfaces 101 of the at least two elements of the second group (21, 31) of elements may be positioned on different levels compared to each other step-wise.

Next, either step 507 or 511 is taken. If step 511 is chosen at this point of the process, no further layers (23-24, 35-36) will be added to the arrangement and assembling the arrangement according to the invention is completed.

Advantageously, if step 507 is chosen, at least one other layer (25, 37-39) is eventually added to the arrangement according to the invention. In step 507 at least one third group (22, 32-34) of at least two first elements is created. The at least one third group (22, 32-34) of at least two third elements is created and an individual third element comprises at least one first edge surface 101 and at least one second edge surface 102 that are on a distance from each other, at least one slot 105, and a neck 106 with less height than the distance of the at least one first edge surface 101 and the at least one second edge surface 102. For the at least one third group (22, 32-34) of at least two third elements, the at least two third elements can be fitted at least partially together crosswise so that at least one slot 105 of at least one third element is at least partially dimensioned against a neck 106 of at least one other third element.

In step 508 the at least two third elements are fitted at least partially together correspondingly. Further, the at least two third elements are fitted at least partially together crosswise so that the at least one slot of 105 at least one third element is at least partially dimensioned against the neck 106 of at least one other third element.

More advantageously, according to step 508, the method further comprises fitting the individual elements of one group (20-22, 30-34) of at least two elements at least partially together crosswise together so that the at least one slot (105) of at least one individual element is at least partially dimensioned against the neck (106) of at least one other individual element) of the same group of at least two elements (20-25, 30-39).

In step 509 the at least one second edge surface 102 of at least one third element is also fitted at least partially against at least one first edge surface 101 of at least one element on the previous layer (24, 36-38) of the arrangement. The at least one second edge surface 102 of at least one third element is fitted at least partially along the length of the at least one first edge surface 101 of at least one element on the previously added layer (24, 36-38) on the arrangement.

In step 510 fitting together at least one third group (32-34) of at least two third elements according to steps 507-508 causes adding at least one layer (37-39) to the arrangement. On the now assembled arrangement the first edge surfaces 101 of the at least two first elements of the first group (20, 30) of elements, the first edge surfaces 101 of the at least two second elements (211, 311) of the second group (21, 31) of elements and the first edge surfaces 101 of the at least two third elements of the at least one third group (22, 32-34) of elements are at least partially positioned on the same level compared to each other. Advantageously, on the now assembled arrangement, the first edge surfaces 101 of the at least two first elements of the first group (20, 30) of elements, the first edge surfaces 101 of the at least two second elements (211, 311) of the second group (21, 31) of elements and the first edge surfaces 101 of the at least two third elements of the at least one third group (22, 32-34) of elements may be positioned on different levels compared to each other. Also, on the now assembled arrangement, the first edge surfaces 101 of the at least two first elements of the first group (20, 30) of elements, the first edge surfaces 101 of the at least two second elements of the second group (21, 31) of elements and the first edge surfaces 101 of the at least two third elements of the at least one third group (22, 32-34) of elements may be positioned on different levels compared to each other step-wise.

More advantageously, on the now assembled arrangement, the first edge surfaces 101 of the at least two first elements of the first group (20, 30) of elements, the first edge surfaces 101 of the at least two second elements of the second group (21, 31) of elements and the first edge surfaces 101 of the at least two third elements of the at least one third group (22, 32-34) of elements are positioned on different levels compared to each other. Finally, the first edge surfaces 101 of the at least two first elements of the first group (20, 30) of elements, the first edge surfaces 101 of the at least two second elements of the second group (21, 31) of elements and the first edge surfaces 101 of the at least two third elements of the at least one third group (22, 32-34) of elements are positioned on different levels compared to each other step-wise.

Advantageously, according to the method, steps 507-510 may now be repeated if further layers should be added to the arrangement. If no further layers should be added to the arrangement, the method is completed by choosing step 511 and the arrangement according to the invention is assembled.

Very advantageously, according to steps 502,504-505 and 508-511, the method further comprises fitting the individual elements of one group (20-22, 30-34) of at least two elements at least partially together crosswise together so that the at least one slot (105) of at least one individual element is at least partially dimensioned against the neck (106) of at least one other individual element, of the same group of at least two elements (20-25, 30-39). The method according to steps 502, 504-505 and 508-511, also comprises fitting at least one second edge surface 102 of at least one individual second or third element at least partially against at least one first edge surface 101 of at least one individual first, second or third element on the previous layer (23-25, 35-39) of the arrangement.

Very advantageously, the method according to steps 501-511 further comprises forming a three-dimensional object by assembling the arrangement (25-25, 35-39).

Finally, the individual elements of the arrangement, before assembly, may be packaged to container. Advantageously, the individual elements of the arrangement, before assembly, may be packaged to container so that elements similar to each other are packed together to save packaging space. Advantageously, the individual elements of the arrangement, before assembly, may be packaged to a container so that elements similar to each other that belong to the same group of elements (20-22, 30-34) are packed together to save packaging space. More advantageously, the individual elements of the arrangement, before assembly, may be packaged to a container so that elements similar to each other that belong to the same group of elements (20-22, 30-34) are packed together to save packaging space and the container itself guides how the individual elements should be packed to the container.

It is obvious to a person skilled in the art that the basic idea of the invention may be implemented in various ways and is not limited to a certain number of individual elements, order of connecting or fitting together individual elements, number of layers in the arrangement, form of an individual element or form or number of connecting elements or joint parts. The invention and the embodiments thereof are thus not restricted to the above examples but may vary within the scope of the claims. Different features may thus be left out, processed or replaced by equivalent ones.

What is claimed is:

1. An assemblable arrangement comprising:

forms a first group of at least two first elements, each element comprising:

a first edge surface and a second edge surface, the first and second edge surfaces being parallel to each other and each having a thickness, at least one vertical slot having an open end and a closed end, the open end being on the first or the second edge surface, the closed end defining an inner slot that is co-axial with the vertical slot, and a solid neck abutting the closed end of the at least one vertical slot, and the at least two first elements being configured to be fitted together crosswise so that the at least one vertical slot of at least one first element is dimensioned against the solid neck of at least one other first element;

wherein the crosswise configuration of the first group of the at least two first element positions each of the second edge surfaces so as to form a cross-shaped level base where the second edge surfaces radiate from an axis formed by the vertical slot; and, wherein the second edge surfaces of the at least two elements of the first group of elements are positioned on the same level compared to each other when fitted together in the crosswise configuration;

and a second group of at least two second elements, each element comprising:

a first edge surface and a second edge surface, the first and second edge surfaces being parallel to each other and each having a thickness, at least one vertical slot, having an open end and a closed end, the open end being on the first or the second edge surface, the closed end defining an inner slot that is co-axial with the vertical slot, and a solid neck-abutting the closed end of the at least one vertical slot, and the at least two second elements being configured to be fitted together crosswise so that the at least one vertical slot of at least one second element is dimensioned against the solid neck of at least one other second element, and the thickness of the second edge surface of at least one second element being configured to be fitted at least partially against the thickness of the first edge surface of at least one first element so that each group of elements vertical layer of the arrangement;

wherein the arrangement forms a non-collapsible three-dimensional object when assembled;

wherein the arrangement further comprises at least one additional vertical layer above the layers formed by the first group of elements and the second group of elements, wherein the at least one additional layer comprises at least one third group of at least two third elements, each element comprising:

a first edge surface and a second edge surface, the first edge and the second edge surfaces being parallel to each other and each having a thickness, at least one vertical slot, having an open end and a closed end, the open end being on the first or the second edge surface, the closed end defining an inner slot that is co-axial with the vertical slot, and a solid neck abutting the closed end of the at least one vertical slot, and the at least two third elements being configured to be fitted together crosswise so that the at least one vertical slot of at least one third element is dimensioned against the neck of at least one other third element, the thickness of the second edge surface of at least one third element is configured to be fitted at least partially against the thickness of the first edge surface of at least one element of a layer below the at least one additional layer;

and, wherein at least one connection element configured to connect the arrangement with another arrangement at a distance, wherein the at least one connection element comprises:

a first end and a second end;

a first edge surface and a second edge surface, the first and second edge surfaces being at least partially parallel;

two vertical slots located at the second end of the connection element, each slot having an open end, one open end being on the edge surface and the other one on the second edge surface, at least one vertical slot located at the first end of the connection element, the slot having an open end on the second edge surface, a solid area having a length between the slots at the end and at the second end, the at least one connection element being configured to be fitted together crosswise with at least one individual element of at least one group of at least two elements so that the vertical slot on the second edge surface at the first end of the at least one connection element is dimensioned against the solid neck of the at least one individual element of the at least one group of at least two elements, and the vertical slot on the second edge surface at the second end is configured to be fitted together with an individual element of a second arrangement, wherein the length of the solid area of the at least one connection element defines the distance between the arrangements.

2. The arrangement according to claim 1, wherein the first edge surfaces of the elements of each group are on a same level with each other in the arrangement when assembled.

3. The arrangement according to claim 1, wherein the first edge surfaces of the elements of each group are positioned on different levels with each other in the arrangement when assembled.

4. The arrangement according to claim 1, wherein the arrangement comprises several connection elements configured to be connected to each other by fitting a vertical slot on a second edge surface of the second end of one connection element, and wherein the vertical slots at ends that are not attached together are configured to fit against the solid neck of the at least one individual element of the at least one group of at least two elements of an arrangement.

5. The arrangement according to claim 4, wherein the arrangement further comprises at least one joint part configured to be fitted together with the at least one connection element.

6. The arrangement according to claim 1, wherein the arrangement further comprises at least one joint organ on the thickness of the first edge surface of at least one the first element, and at least one joint organ on the thickness of the second edge surface of at least one second element; and the at least one joint organ of the first element and the at least one joint organ of the second element fit together such that the at least one first edge surface of the first element becomes attached to the at least one second edge surface of the second element.

7. The arrangement according to claim 6, wherein the joint organs are selected from taps and holes.

* * * * *